US010685638B2

(12) United States Patent
Jarvinen et al.

(10) Patent No.: US 10,685,638 B2
(45) Date of Patent: Jun. 16, 2020

(54) AUDIO SCENE APPARATUS

(71) Applicant: NOKIA TECHNOLOGIES OY, Espoo (FI)

(72) Inventors: Kari Juhani Jarvinen, Tampere (FI); Antti Eronen, Tampere (FI); Juha Henrik Arrasvuori, Tampere (FI); Roope Olavi Jarvinen, Lempäälä (FI); Miikka Vilermo, Siuro (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

(21) Appl. No.: 16/242,390

(22) Filed: Jan. 8, 2019

(65) Prior Publication Data

US 2019/0139530 A1 May 9, 2019

Related U.S. Application Data

(63) Continuation of application No. 14/893,204, filed as application No. PCT/IB2013/054514 on May 31, 2013, now Pat. No. 10,204,614.

(51) Int. Cl.
*G10K 11/175* (2006.01)
*H04R 1/10* (2006.01)
(Continued)

(52) U.S. Cl.
CPC ..... *G10K 11/175* (2013.01); *G10K 11/17885* (2018.01); *H04R 1/1083* (2013.01);
(Continued)

(58) Field of Classification Search
CPC ..... G10K 11/175; G10K 11/17885; G10K 11/178; G10K 2210/108; H04R 1/1083;
(Continued)

(56) References Cited

U.S. PATENT DOCUMENTS 4,985,925 A 1/1991 Langberg et al.
6,188,771 B1 2/2001 Horrall
(Continued)

FOREIGN PATENT DOCUMENTS

EP 2 239 728 A2 10/2010
JP 2012-095262 A 10/1920
(Continued)

OTHER PUBLICATIONS

U.S. Appl. No. 14/893,204, filed Nov. 23, 2015, U.S. Pat. No. 10,204,614, Patented.
(Continued)

*Primary Examiner* — Yogeshkumar Patel
(74) *Attorney, Agent, or Firm* — Alston & Bird LLP

(57) ABSTRACT

An apparatus comprising an audio detector configured to analyse a first audio signal to determine at least one audio source, wherein the first audio signal is generated from the sound-field in the environment of the apparatus; an audio generator configured to generate at least one further audio source; and a mixer configured to mix the at least one audio source and the at least one further audio source such that the at least one further audio source is associated with the at least one audio source.

20 Claims, 13 Drawing Sheets

(51) Int. Cl.

| | |
|---|---|
| ***G10K 11/178*** | (2006.01) |
| ***H04R 3/00*** | (2006.01) |
| ***H04S 3/00*** | (2006.01) |
| ***H04S 7/00*** | (2006.01) |

(52) U.S. Cl.
CPC ..... *G10K 11/178* (2013.01); *G10K 2210/108* (2013.01); *H04R 3/005* (2013.01); *H04R 2460/01* (2013.01); *H04S 3/004* (2013.01); *H04S 7/30* (2013.01); *H04S 2400/01* (2013.01); *H04S 2400/03* (2013.01); *H04S 2400/11* (2013.01); *H04S 2420/01* (2013.01)

(58) Field of Classification Search
CPC . H04R 3/005; H04R 2460/01; H04S 2420/03; H04S 2400/01; H04S 2400/11; H04S 7/30; H04S 2420/01; H04S 3/004
USPC ..... 381/99, 103, 22, 23, 307
See application file for complete search history.

(56) References Cited

U.S. PATENT DOCUMENTS

| | | | |
|---|---|---|---|
| 6,198,427 | B1 | 3/2001 | Aker et al. |
| 7,613,175 | B2 | 11/2009 | Khasnabish |
| 7,688,810 | B2 | 3/2010 | Khasnahish |
| 7,715,372 | B2 | 5/2010 | Khasnabish |
| 8,401,212 | B2 | 3/2013 | Puria et al. |
| 8,515,759 | B2 | 8/2013 | Engdegard et al. |
| 9,015,051 | B2 | 4/2015 | Pulkki |
| 9,794,709 | B2 | 10/2017 | Jung |
| 9,835,062 | B2 | 12/2017 | Jung |
| 9,870,764 | B2 | 1/2018 | Marti et al. |
| 2004/0252846 | A1 | 12/2004 | Nonaka et al. |
| 2006/0109983 | A1 | 5/2006 | Young et al. |
| 2006/0188104 | A1 | 8/2006 | De Poortere et al. |
| 2007/0146127 | A1 | 6/2007 | Stilp et al. |
| 2008/0130908 | A1* | 6/2008 | Cohen ..... H04S 1/00 381/71.1 |
| 2008/0192941 | A1 | 8/2008 | Oh et al. |
| 2008/0319564 | A1* | 12/2008 | Furge ..... H03G 3/32 700/94 |
| 2009/0046864 | A1 | 2/2009 | Mahabub et al. |
| 2009/0070104 | A1 | 3/2009 | Jones et al. |
| 2009/0214050 | A1 | 8/2009 | Sawashi |
| 2010/0128882 | A1 | 5/2010 | Yamabe et al. |
| 2010/0215198 | A1 | 8/2010 | Ngia et al. |
| 2011/0038496 | A1 | 2/2011 | Lott et al. |
| 2011/0200196 | A1 | 8/2011 | Disch et al. |
| 2012/0093338 | A1 | 4/2012 | Levi et al. |
| 2012/0163606 | A1 | 6/2012 | Eronen et al. |
| 2012/0170756 | A1 | 7/2012 | Kraemer et al. |
| 2012/0281856 | A1 | 11/2012 | Georgiou et al. |
| 2012/0288126 | A1 | 11/2012 | Karkkainen et al. |
| 2013/0094683 | A1 | 4/2013 | Hansen |
| 2013/0114821 | A1 | 5/2013 | Hamalainen |
| 2013/0121506 | A1 | 5/2013 | Mysore et al. |
| 2013/0170662 | A1 | 7/2013 | Koga et al. |
| 2013/0329895 | A1 | 12/2013 | Dusan et al. |
| 2014/0016786 | A1 | 1/2014 | Sen |
| 2014/0086414 | A1 | 3/2014 | Vilermo et al. |
| 2014/0254820 | A1 | 9/2014 | Gardenfors et al. |
| 2015/0030175 | A1 | 1/2015 | Roggenkamp et al. |
| 2015/0036832 | A1 | 2/2015 | Usher et al. |
| 2015/0039302 | A1 | 2/2015 | Jarvinen et al. |
| 2015/0043744 | A1 | 2/2015 | Lagodzinski et al. |
| 2015/0256140 | A1 | 9/2015 | Smith |
| 2015/0256669 | A1 | 9/2015 | James et al. |
| 2015/0256930 | A1 | 9/2015 | Yamakawa |
| 2015/0264499 | A1 | 9/2015 | Valeri et al. |
| 2015/0281829 | A1 | 10/2015 | Gauger, Jr. et al. |
| 2015/0281830 | A1 | 10/2015 | Gauger, Jr. et al. |
| 2016/0372103 | A1 | 12/2016 | Jung |

FOREIGN PATENT DOCUMENTS

| | | | |
|---|---|---|---|
| WO | WO 2009/071896 | A1 | 6/2009 |
| WO | WO 2009/117471 | A1 | 9/2009 |
| WO | WO 2010/048490 | A1 | 4/2010 |
| WO | WO 2011/127476 | A1 | 10/2011 |
| WO | WO 2012/043597 | A1 | 4/2012 |
| WO | WO 2012/097150 | A1 | 7/2012 |

OTHER PUBLICATIONS

3GPP TS 26.192 "Speech codec speech processing functions; Adaptive Multi-Rate-Wideband (AMR-WB) speech codec; Comfort noise aspects"; Release 9; Dec. 2009; 13 pages.

Active Noise Control (ANC)—Wikipedia [online] [retrieved Feb. 3, 2017]. Retrieved from the Internet: <URL:http://en.wikipedia.org/wiki/Active_noise_control>. 3 pages.

Butz, A. and June, R.; "Seamless User Notification in Ambient Soundscapes"; Proceedings of the 10th International Conference on Intelligent User Interfaces; 2005; 3 pages.

Comfort Noise—Wikipedia [online] [retrieved Feb. 3, 2017]. Retrieved from the Internet: <URL:http://en.wikipedia.org/wiki/Comfort_noise>. 2 pages.

Dynamic Time Warping—Wikipedia [online][retrieved Feb. 3, 2017]. Retrieved from the Internet: <URL:http://en.wikipedia.org/wiki/Dynamic_time_warping>. 5 pages.

Ellis, Daniel P.W., "Beat Tracking by Dynamic Prograinining", Journal of New Music Research, vol. 36, No. 1, pp. 51-60, 2007 Retrieved from the Internet: <URL:http://www.ee.columbia.edu/~dpwe/pubs/Ellis07-beattrack.pdf>. 21 pages.

Enhancing Headphone Music Sound Quality [online] [retrieved Feb. 3, 2017] Retrieved from the Internet: <URL:http://projekter.aau.dk/projekter/files/17156367/Sune_Mushendwa_-_MED_10_Thesis.pdf>, 91 pages.

Eronena, A.J. and Klapuri, A.P., "Music Tempo Estimation with k-NN regression", IEEE Transactions on Audio, Speech, and Language Processing, vol. 18, No. 1, pp. 50-57, 2010.

Notice of Allowance for U.S. Appl. No. 14/893,204 dated Sep. 12, 2018.

Office Action for Korean Application No. 10-2015-7037101 dated Apr. 19, 2018, 5 pages.

Office Action for U.S. Appl. No. 14/893,204, dated Mar. 21, 2018, 18 pages.

Quatieri, Thomas F.; "Discrete-Time Speech Signal Processing", Prentice Hall, 2002, p. 712-715.

Sound masking: from Wikipedia [online] [retrieved Feb. 3, 2017]. Retrieved from the Internet: <URL:http://en.wikipedia.org/wiki/Sound_masking<. 31 pages.

Tinnitus Masker [online] [retrieved Feb. 3, 2017]. Retrieved from the internet: <URL:http://en.wikipedia.org/wiki/Tinnitus_masker>. 4 pages.

Office Action for Korean Application No. 10-2015-7037101 dated Jan. 3, 2019.

* cited by examiner

AUDIO SCENE APPARATUS

CROSS REFERENCE TO RELATED APPLICATIONS

This application is a continuation of U.S. patent application Ser. No. 14/893,204, filed Nov. 23, 2015, which is a national phase of International Application No. PCT/IB2013/054514 filed May 31, 2013, which are each incorporated herein by reference in their entireties.

FIELD

The present application relates to apparatus for the processing of audio signals to enable masking the effect of background noise with comfort audio signals. The invention further relates to, but is not limited to, apparatus for processing of audio signals to enable masking the effect of background noise with comfort audio signals at mobile devices.

BACKGROUND

In conventional situations the environment comprises sound fields with audio sources spread in all three spatial dimensions. The human hearing system controlled by the brain has evolved the innate ability to localize, isolate and comprehend these sources in the three dimensional sound field. For example the brain attempts to localize audio sources by decoding the cues that are embedded in the audio wavefronts from the audio source when the audio wavefront reaches our binaural ears. The two most important cues responsible for spatial perception is the interaural time differences (ITD) and the interaural level differences (ILD). For example an audio source located to the left and front of the listener takes more time to reach the right ear when compared to the left ear. This difference in time is called the ITD. Similarly, because of head shadowing, the wavefront reaching the right ear gets attenuated more than the wavefront reaching the left ear, leading to ILD. In addition, transformation of the wavefront due to pinna structure, shoulder reflections can also play an important role in how we localize the sources in the 3D sound field. These cues therefore are dependent on person/listener, frequency, location of audio source in the 3D sound field and environment he/she is in (for example the whether the listener is located in an anechoic chamber/auditorium/living room).

The 3D positioned and externalized audio sound field has become the de-facto natural way of listening.

Telephony and in particular wireless telephony is well known in implementation. Often telephony is carried out in environmentally noisy situations where background noise causes difficulty in understanding what the other party is communicating. This typically results in requests to repeat what the other party has said or stopping the conversation until the noise has disappeared or the user has moved away from the noise source. This is particularly acute in multiparty telephony (such as conference calls) where one or two participants are unable to follow the discussion due to local noise causing severe distraction and unnecessarily lengthening the call duration. Even where the surrounding or environmental noise does not prevent the user from understanding what the other party is communicating it can still be very distracting and annoying preventing the user from focusing completely on what the other party is saying and requiring extra effort in listening.

However, completely dampening or suppressing the environmental or live noise is not desirable as it may provide an indication of an emergency or a situation requiring the user's attention more than the telephone call. Thus active noise cancellation can unnecessarily isolate the user from their surroundings. This could be dangerous where emergency situations occur near to the listener as it could prevent the listener from hearing warning signals from the environment.

SUMMARY

Aspects of this application thus provide a further or comfort audio signal which is substantially configured to mask the effect of background or surrounding live audio field noise signals.

There is provided according to a first aspect an apparatus comprising at least one processor and at least one memory including computer code for one or more programs, the at least one memory and the computer code configured to with the at least one processor cause the apparatus to: analyse a first audio signal to determine at least one audio source, wherein the first audio signal is generated from the soundfield in the environment of the apparatus; generate at least one further audio source; and mix the at least one audio source and the at least one further audio source such that the at least one further audio source is associated with the at least one audio source.

The apparatus may be further caused to analyse a second audio signal to determine at least one audio source; and wherein mixing the at least one audio source and the at least one further audio source may further cause the apparatus to mix the at least one audio source with the at least one audio source and the at least one further audio source.

The second audio signal may be at least one of: a received audio signal via a receiver; and a retrieved audio signal via a memory.

Generating at least one further audio source may cause the apparatus to generate the at least one audio source associated with at least one audio source.

Generating at least one further audio source associated with at least one audio source may cause the apparatus to: select and/or generate from a range of further audio source types at least one further audio source most closely matching the at least one audio source; position the further audio source at a virtual location matching a virtual location of the at least one audio source; and process the further audio source to match the at least one audio source spectra and/or time.

The at least one further audio source associated with the at least one audio source may be at least one of: the at least one further audio source substantially masks the at least one audio source; the at least one further audio source substantially disguises the at least one audio source; the at least one further audio source substantially incorporates the at least one audio source; the at least one further audio source substantially adapts the at least one audio source; and the at least one further audio source substantially camouflages the at least one audio source.

Analysing a first audio signal to determine at least one audio source may cause the apparatus to: determine at least one audio source position; determine at least one audio source spectrum; determine at least one audio source time.

Analysing a first audio signal to determine at least one audio source may cause the apparatus to: determine at least two audio sources; determine an energy parameter value for the at least two audio sources; and select the at least one audio source from the at least two audio sources based on the energy parameter value.

Analysing a first audio signal to determine at least one audio source, wherein the first audio signal is generated from the apparatus audio environment may cause the apparatus to perform: divide the second audio signal into a first number of frequency bands; determine for the first number of frequency bands a second number of dominant audio directions; and select the dominant audio directions where their associated audio components are greater than a determined noise threshold value as the audio source directions.

The apparatus may be further caused to perform receiving the second audio signal from at least two microphones, wherein the microphones are located on or neighbouring the apparatus.

The apparatus may be further caused to perform receiving at least one user input associated with at least one audio source, wherein generating at least one further audio source, wherein the at least one further audio source is associated with at least one audio may cause the apparatus to generate the at least one further audio source based on the at least one user input.

Receiving at least one user input associated with at least one localised audio source may cause the apparatus to perform at least one of: receive at least one user input indicating a range of further audio source types; receive at least one user input indicating an audio source position; and receive at least one user input indicating a source for a range of further audio source types.

According to a second aspect there is provided an apparatus comprising: means for analysing a first audio signal to determine at least one audio source, wherein the first audio signal is generated from the sound-field in the environment of the apparatus; means for generating at least one further audio source; and means for mixing the at least one audio source and the at least one further audio source such that the at least one further audio source is associated with the at least one audio source.

The apparatus may further comprise means for analysing a second audio signal to determine at least one audio source; and wherein the means for mixing the at least one audio source and the at least one further audio source may further comprise means for mixing the at least one audio source with the at least one audio source and the at least one further audio source.

The second audio signal may be at least one of: a received audio signal via a receiver; and a retrieved audio signal via a memory.

The means for generating at least one further audio source may comprise means for generating the at least one audio source associated with at least one audio source.

The means for generating at least one further audio source associated with at least one audio source may comprise: means for selecting and/or generating from a range of further audio source types at least one further audio source most closely matching the at least one audio source; means for positioning the further audio source at a virtual location matching a virtual location of the at least one audio source; and means for processing the further audio source to match the at least one audio source spectra and/or time.

The at least one further audio source associated with the at least one audio source may be at least one of: the at least one further audio source substantially masks the at least one audio source; the at least one further audio source substantially disguises the at least one audio source; the at least one further audio source substantially incorporates the at least one audio source; the at least one further audio source substantially adapts the at least one audio source; and the at least one further audio source substantially camouflages the at least one audio source.

The means for analysing a first audio signal to determine at least one audio source may comprise: means for determining at least one audio source position; means for determining at least one audio source spectrum; and means for determining at least one audio source time.

The means for analysing a first audio signal to determine at least one audio source may comprise: means for determining at least two audio sources; means for determining an energy parameter value for the at least two audio sources; and means for selecting the at least one audio source from the at least two audio sources based on the energy parameter value.

The means for analysing a first audio signal to determine at least one audio source, wherein the first audio signal is generated from the apparatus audio environment may comprise: means for dividing the second audio signal into a first number of frequency bands; means for determining for the first number of frequency bands a second number of dominant audio directions; and means for selecting the dominant audio directions where their associated audio components are greater than a determined noise threshold value as the audio source directions.

The apparatus may further comprise means for receiving the second audio signal from at least two microphones, wherein the microphones are located on or neighbouring the apparatus.

The apparatus may comprise means for receiving at least one user input associated with at least one audio source, wherein the means for generating at least one further audio source, wherein the at least one further audio source is associated with at least one audio may comprise means for generating the at least one further audio source based on the at least one user input.

The means for receiving at least one user input associated with at least one localised audio source may comprise at least one of: means for receiving at least one user input indicating a range of further audio source types; means for receiving at least one user input indicating an audio source position; and means for receiving at least one user input indicating a source for a range of further audio source types.

According to a third aspect there is provided a method comprising: analysing a first audio signal to determine at least one audio source, wherein the first audio signal is generated from the sound-field in the environment of the apparatus; generating at least one further audio source; and mixing the at least one audio source and the at least one further audio source such that the at least one further audio source is associated with the at least one audio source.

The method may further comprise analysing a second audio signal to determine at least one audio source; and wherein mixing the at least one audio source and the at least one further audio source may further comprise mixing the at least one audio source with the at least one audio source and the at least one further audio source.

The second audio signal may be at least one of: a received audio signal via a receiver; and a retrieved audio signal via a memory.

Generating at least one further audio source may comprise generating the at least one audio source associated with at least one audio source.

Generating at least one further audio source associated with at least one audio source may comprise: selecting and/or generating from a range of further audio source types at least one further audio source most closely matching the at least one audio source; positioning the further audio source at a virtual location matching a virtual location of the at least one audio source; and processing the further audio source to match the at least one audio source spectra and/or time.

The at least one further audio source associated with the at least one audio source may be at least one of: at least one further audio source substantially masking the at least one audio source; at least one further audio source substantially disguising the at least one audio source; at least one further audio source substantially incorporating the at least one audio source; at least one further audio source substantially adapting the at least one audio source; and at least one further audio source substantially camouflaging the at least one audio source.

Analysing a first audio signal to determine at least one audio source may comprise: determining at least one audio source position; determining at least one audio source spectrum; and determining at least one audio source time.

Analysing a first audio signal to determine at least one audio source may comprise: determining at least two audio sources; determining an energy parameter value for the at least two audio sources; and selecting the at least one audio source from the at least two audio sources based on the energy parameter value.

Analysing a first audio signal to determine at least one audio source, wherein the first audio signal is generated from the apparatus audio environment may comprise: dividing the second audio signal into a first number of frequency bands; determining for the first number of frequency bands a second number of dominant audio directions; and selecting the dominant audio directions where their associated audio components are greater than a determined noise threshold value as the audio source directions.

The method may further comprise receiving the second audio signal from at least two microphones, wherein the microphones are located on or neighbouring the apparatus.

The method may comprise receiving at least one user input associated with at least one audio source, wherein generating at least one further audio source, wherein the at least one further audio source is associated with at least one audio may comprise generating the at least one further audio source based on the at least one user input.

Receiving at least one user input associated with at least one localised audio source may comprise at least one of: receiving at least one user input indicating a range of further audio source types; receiving at least one user input indicating an audio source position; and receiving at least one user input indicating a source for a range of further audio source types.

According to a fourth aspect there is provided an apparatus comprising: an audio detector configured to analyse a first audio signal to determine at least one audio source, wherein the first audio signal is generated from the soundfield in the environment of the apparatus; an audio generator configured to generate at least one further audio source; and a mixer configured to mix the at least one audio source and the at least one further audio source such that the at least one further audio source is associated with the at least one audio source.

The apparatus may further comprise a further audio detector configured to analyse a second audio signal to determine at least one audio source; and wherein the mixer is configured to mix the at least one audio source with the at least one audio source and the at least one further audio source.

The second audio signal may be at least one of: a received audio signal via a receiver; and a retrieved audio signal via a memory.

The audio generator may be configured to generate the at least one further audio source associated with at least one audio source.

The audio generator configured to generate the at least one further audio source associated with the at least one audio source may be configured to: select and/or generate from a range of further audio source types at least one further audio source most closely matching the at least one audio source; position the further audio source at a virtual location matching a virtual location of the at least one audio source; and process the further audio source to match the at least one audio source spectra and/or time.

The at least one further audio source associated with the at least one audio source may be at least one of: at least one further audio source substantially masking the at least one audio source; at least one further audio source substantially disguising the at least one audio source; at least one further audio source substantially incorporating the at least one audio source; at least one further audio source substantially adapting the at least one audio source; and at least one further audio source substantially camouflaging the at least one audio source.

The audio detector may be configured to: determine at least one audio source position; determine at least one audio source spectrum; and determine at least one audio source time.

The audio detector may be configured to: determine at least two audio sources; determine an energy parameter value for the at least two audio sources; select the at least one audio source from the at least two audio sources based on the energy parameter value.

The audio detector may be configured to: divide the second audio signal into a first number of frequency bands; determine for the first number of frequency bands a second number of dominant audio directions; and select the dominant audio directions where their associated audio components are greater than a determined noise threshold value as the audio source directions.

The apparatus may further comprise an input configured to receive the second audio signal from at least two microphones, wherein the microphones are located on or neighbouring the apparatus.

The apparatus may further comprise a user input configured to receive at least one user input associated with at least one audio source, wherein the audio generator is configured to generate the at least one further audio source based on the at least one user input.

The user input may be configured to: receive at least one user input indicating a range of further audio source types; receive at least one user input indicating an audio source position; and receive at least one user input indicating a source for a range of further audio source types.

According to a fifth aspect there is provided an apparatus comprising: a display; at least one processor; at least one memory; at least one microphone configured to generate a first audio signal; an audio detector configured to analyse the first audio signal to determine at least one audio source, wherein the first audio signal is generated from the soundfield in the environment of the apparatus; an audio generator configured to generate at least one further audio source; and a mixer configured to mix the at least one audio source and the at least one further audio source such that the at least one further audio source is associated with the at least one audio source.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

The following describes in further detail suitable apparatus and possible mechanisms for the provision of effective further or comfort audio signals configured to mask surrounding live audio field noise signals or 'local' noise. In the following examples, audio signals and audio capture signals are described. However it would be appreciated that in some embodiments the audio signal/audio capture is a part of an audio-video system.

The concept of embodiments of the application is to provide intelligibility and quality improvement of the spatial audio when listened in noisy audio environments.

Figure 1:
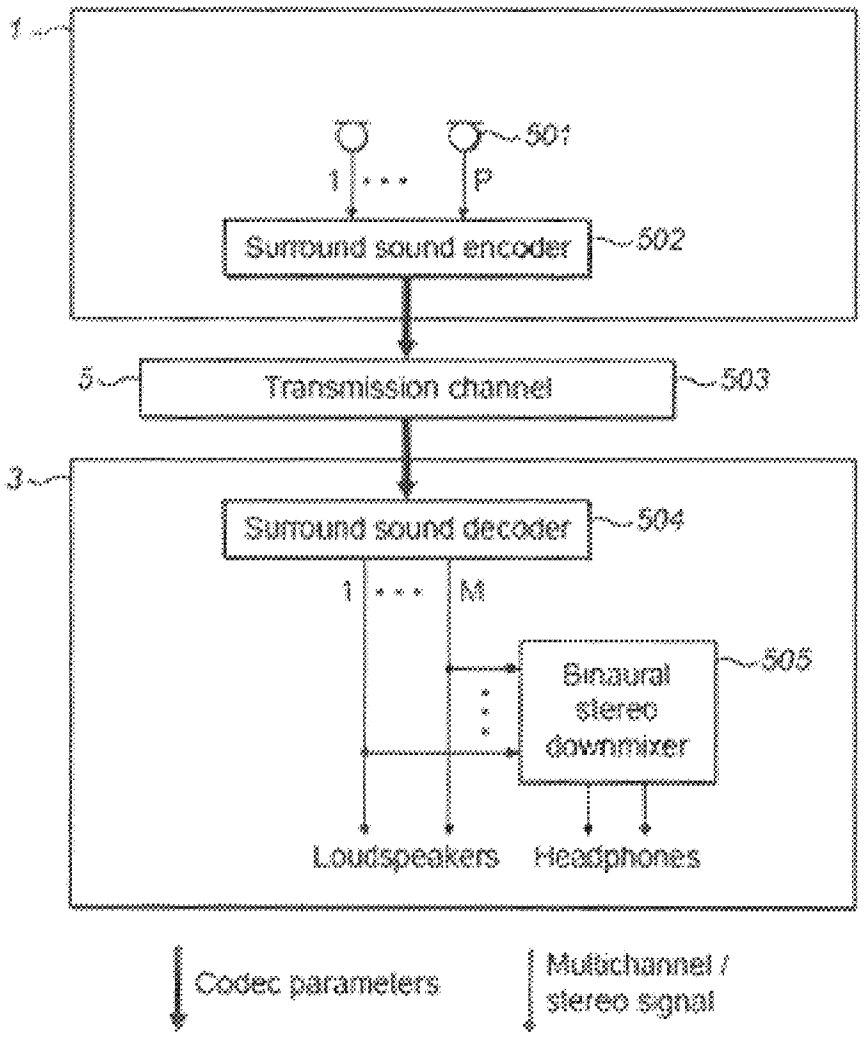
FIG. 1 shows an example of a typical telephony system utilising spatial audio coding.

An example of the typical telephony spatial audio coding system is shown in FIG. 1 in order to illustrate the problems associated with conventional spatial telephony. A first apparatus 1 comprises a set of microphones 501. In the example shown in FIG. 1 there are P microphones which pass generated audio signals to a surround sound encoder.

The first apparatus 1 further comprises a surround sound encoder 502. The surround sound encoder 502 is configured to encode the P generated audio signals in a suitable manner to be passed over the transmission channel 503.

The surround sound encoder 502 can be configured to incorporate a transmitter suitable for transmitting over the transmission channel.

The system further comprises a transmission channel 503 over which the encoded surround sound audio signals are passed. The transmission channel passes the surround sound audio signals to a second apparatus 3.

The second apparatus is configured to receive codec parameters and decode these using a suitable decoder and transfer matrix. The surround sound decoder 504 can in some embodiments be configured to output a number of multichannel audio signals to M loudspeakers. In the example shown in FIG. 1 there are M outputs from the surround sound decoder 504 passed to M loudspeakers to create a surround sound representation of the audio signal generated by the P microphones of the first apparatus.

In some embodiments the second apparatus 3 further comprises a binaural stereo downmixer 505. The binaural stereo downmixer 505 can be configured to receive the multi-channel output (for example M channels) and downmix the multichannel representation into a binaural representation of spatial sound which can be output to headphones (or headsets or earpieces).

It would be understood that any suitable surround sound codec or other spatial audio codec can be used by the surround sound encoder/decoder. For example surround sound codecs include Moving Picture Experts Group (MPEG) surround and parametric object based MPEG spatial audio object coding (SAOC).

The example shown in FIG. 1 is a simplified block diagram of a typical telephony system and therefore for simplification purposes does not discuss transmission encoding or similar. Furthermore it would be understood that the example shown in FIG. 1 shows one way communication but the first and second apparatus could comprise the other apparatus parts to enable two way communication.

Figure 2:
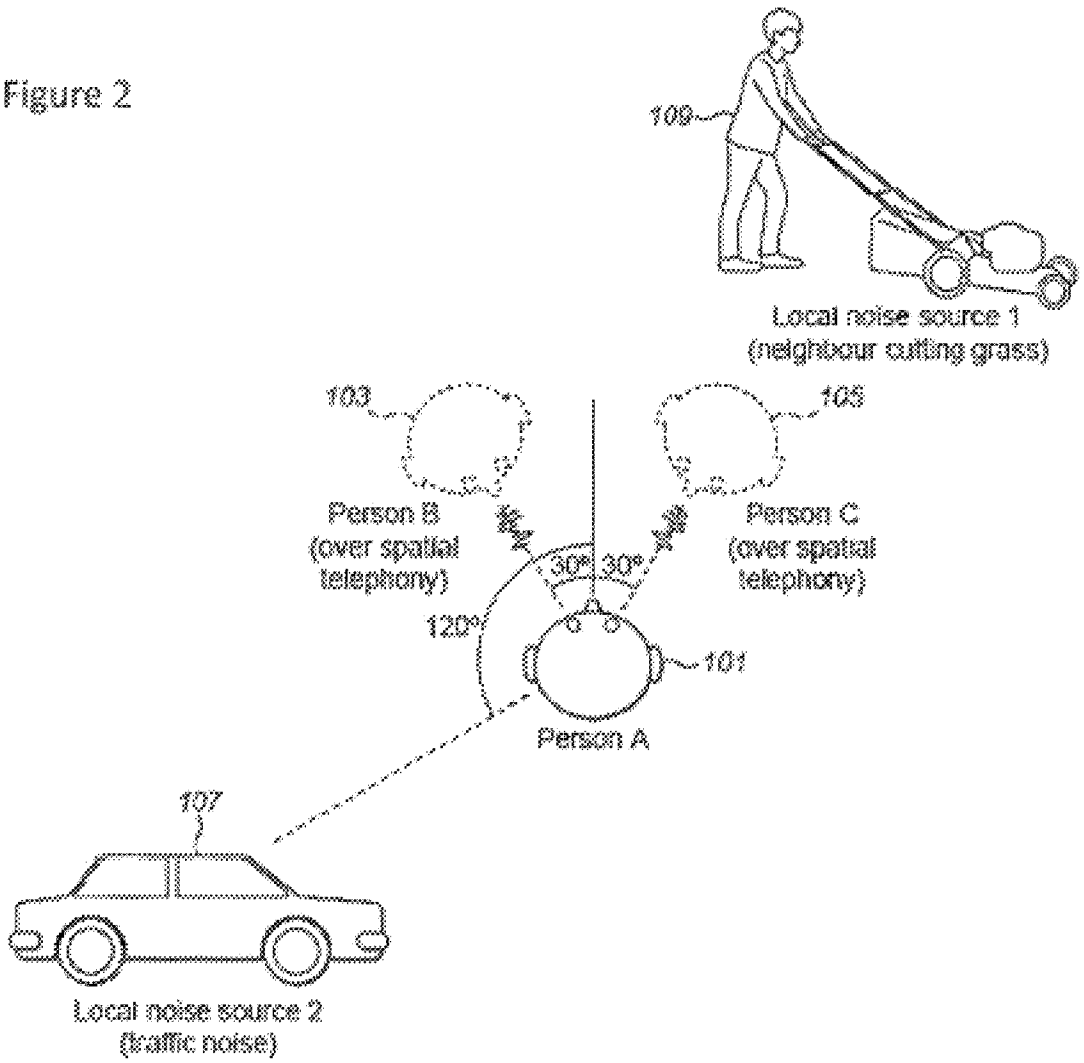
FIG. 2 shows an illustration of a conference call using the system shown in FIG. 1.

An example problem which can occur using the system shown in FIG. 1 is shown in FIG. 2 where person A 101 is attempting a teleconference with person B 103 and person C 105 over spatial telephony. The spatial sound encoding can be performed such that for the person A 101 the surround sound decoder 504 is configured to position person B 103 approximately 30 degrees to the left of the front (mid line) of person A 101 and position person C approximately 30 degrees to the right of the front of person A 101. As shown in FIG. 2 the environmental noise for person A can be seen as traffic noise (local noise source 2 107) approximately 120 degrees to the left of person A and a neighbour cutting the grass using a lawn mower (local noise source 1 109) approximately 30 degrees to the right of person A.

The local noise source 1 would make it very difficult for person A 101 to hear what person C 105 is saying because both person C (from spatial sound decoding) and the noise source 1 in the local live audio environment surrounding the listener (person A 101) 109 are heard from approximately the same direction. It would be understood that although noise source 2 is a distraction it would have less or little impact on the ability of person A 101 to hear any of the participants since the direction is distinct from the voices of the participants of the conference call.

The concept of embodiments of the application is therefore to improve the quality of spatial audio through the use of audio signal processing to insert matched further or comfort audio signals which is substantially configured to mask noise sources in the local live audio environment. In other words there can be an improvement to the audio quality by adding further or comfort audio signals which are matched to surrounding live audio field noise signals.

It would be understood that commonly the live audio field noise signals are processed by suppressing any surrounding noise using Active Noise Cancellation (ANC) where microphone(s) capture the sound signal coming from the environment. The noise cancellation circuitry inverts the wave of the captured sound signal and sums it to the noise signal. Optimally the resulting effect is that the rendered captured noise signal in opposite phase cancels the noise signal coming from the environment.

However by doing so it can often produce an uncomfortable resultant audio product in the form of 'artificial silence'. Also, ANC may not be able to cancel all the noise. ANC may leave some residual noise that may be perceived as annoying. Such residual noise may also sound unnatural and therefore be disturbing to the listener even though having low volume. Comfort audio signals or audio sources such as employed in the embodiments herein does not attempt to cancel the background noise but instead attempts to mask the noise sources or make the noise sources less annoying/audible.

The concept thus according to the embodiments described herein is to provide a signal which attempts to perform sound masking by the addition of natural or artificial sound (such as white noise or pink noise) into an environment to cover up unwanted sound. The sound masking signal thus attempts to reduce or eliminate awareness of pre-existing sounds in a given area and can make a work environment more comfortable, while creating speech privacy so workers can concentrate and be more productive. In the concept as discussed herein an analysis is performed on the 'live' audio around the apparatus and further or comfort audio objects are added in a spatial manner. In other words the spatial directions of noise or audio objects are analysed for spatial directions and further or comfort audio object(s) are added into the corresponding spatial direction(s). In some embodiments as discussed herein the further audio or comfort object is personalized for an individual user and is not tied to use in any specific environment or location.

The concept in other words attempts to remove/reduce the impact of background noise (or any sound perceived by user as disturbing) coming from the "live" audio environment around the user and make the background noise less disturbing (for example for listening of music with the device). This is achieved by recording with a set of microphones the live spatial sound field around the user device, then monitoring and analyzing the live audio field, and finally hiding the background noise behind a suitably matched or formed spatial "comfort audio" signal comprising comfort audio objects. The comfort audio signal is spatially matched to the background noise, and the hiding is complemented by spectral and temporal matching. The matching is based on continuous analysis of the live audio environment around the listener with a set of microphones and subsequent processing. The embodiments as described herein thus do not aim to remove or reduce the surrounding noise per se but instead make it less audible, less annoying and less disturbing for the listener.

The spatially, spectrally and temporally matched further or comfort audio signal can in some embodiments be produced from a set of candidate further or comfort audio signals which are preferably personalized for each user. For example in some embodiments the comfort audio signals are from the collection of favourite music of the listener and remixed (in other words rebalancing or repositioning some of the music's instruments) or it may be artificially generated, or it may be a combination of these two. The spectral, spatial and temporal characteristics of the comfort audio signal is selected or processed to match those of the dominant noise source(s) hence enabling the hiding. The aim of inserting the comfort audio signal is to attempt to block the dominant live noise source(s) from being heard or make the combination of the live noise and the further or comfort audio (when heard simultaneously) more pleasant for the listener than the live noise alone. In some embodiments the further or comfort audio consists of audio objects which are individually positioned in the spatial audio environment. This for example would enable a single piece of music comprising several audio objects to efficiently mask several noise sources in different spatial locations while leaving the audio environment in other directions intact.

Figure 6:
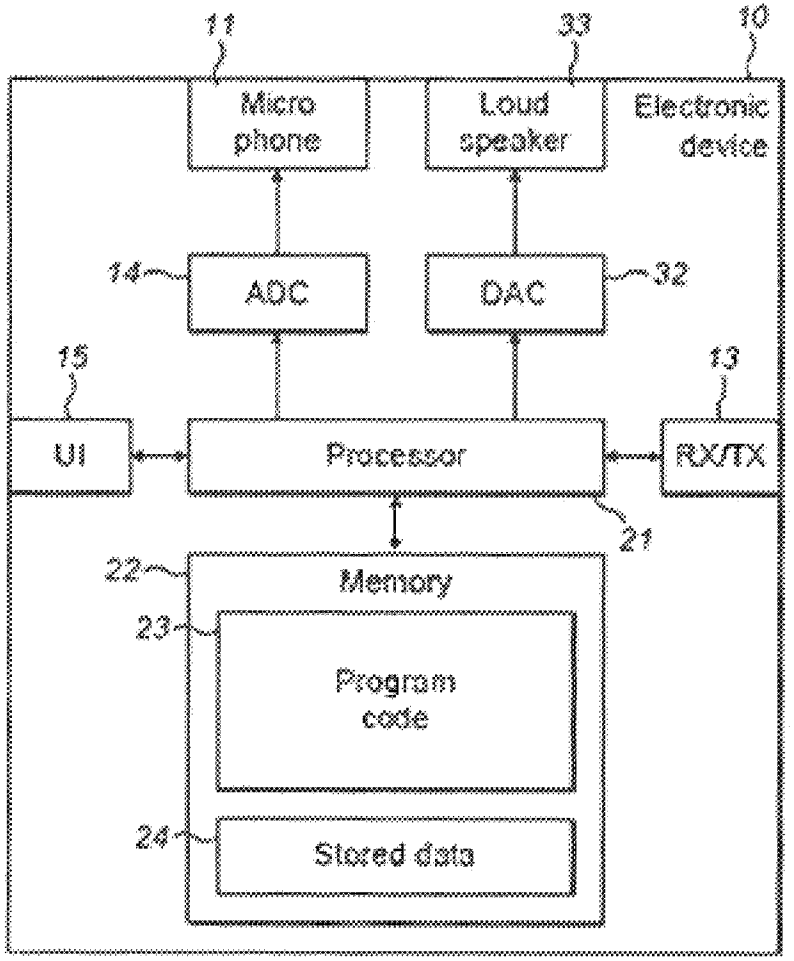
FIG. 6 shows schematically an apparatus suitable for being employed in embodiments of the application.

In this regard reference is first made to FIG. 6 which shows a schematic block diagram of an exemplary apparatus or electronic device 10, which may be used to operate as the first 201 (encoder) or second 203 (decoder) apparatus in some embodiments.

The electronic device or apparatus 10 may for example be a mobile terminal or user equipment of a wireless communication system when functioning as the spatial encoder or decoder apparatus. In some embodiments the apparatus can be an audio player or audio recorder, such as an MP3 player, a media recorder/player (also known as an MP4 player), or any suitable portable device suitable for recording audio or audio/video camcorder/memory audio or video recorder.

The apparatus 10 can in some embodiments comprise an audio subsystem. The audio subsystem for example can comprise in some embodiments a microphone or array of microphones 11 for audio signal capture. In some embodiments the microphone or array of microphones can be a solid state microphone, in other words capable of capturing audio signals and outputting a suitable digital format signal. In some other embodiments the microphone or array of microphones 11 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphone 11 or array of microphones can in some embodiments output the audio captured signal to an analogue-to-digital converter (ADC) 14.

In some embodiments the apparatus can further comprise an analogue-to-digital converter (ADC) 14 configured to receive the analogue captured audio signal from the microphones and outputting the audio captured signal in a suitable digital form. The analogue-to-digital converter 14 can be any suitable analogue-to-digital conversion or processing means.

In some embodiments the apparatus 10 audio subsystem further comprises a digital-to-analogue converter 32 for converting digital audio signals from a processor 21 to a suitable analogue format. The digital-to-analogue converter (DAC) or signal processing means 32 can in some embodiments be any suitable DAC technology.

Furthermore the audio subsystem can comprise in some embodiments a speaker 33. The speaker 33 can in some embodiments receive the output from the digital-to-analogue converter 32 and present the analogue audio signal to the user. In some embodiments the speaker 33 can be representative of a headset, for example a set of headphones, or cordless headphones.

Although the apparatus 10 is shown having both audio capture and audio presentation components, it would be understood that in some embodiments the apparatus 10 can comprise one or the other of the audio capture and audio presentation parts of the audio subsystem such that in some embodiments of the apparatus the microphone (for audio capture) or the speaker (for audio presentation) are present.

In some embodiments the apparatus 10 comprises a processor 21. The processor 21 is coupled to the audio subsystem and specifically in some examples the analogue-to-digital converter 14 for receiving digital signals representing audio signals from the microphone 11, and the digital-to-analogue converter (DAC) 12 configured to output processed digital audio signals. The processor 21 can be configured to execute various program codes. The implemented program codes can comprise for example surround sound decoding, detection and separation of audio objects, determination of audio object reposition of audio objects, clash or collision audio classification and audio source mapping code routines.

In some embodiments the apparatus further comprises a memory 22. In some embodiments the processor is coupled to memory 22. The memory can be any suitable storage means. In some embodiments the memory 22 comprises a program code section 23 for storing program codes implementable upon the processor 21. Furthermore in some embodiments the memory 22 can further comprise a stored data section 24 for storing data, for example data that has been processed or to be processed in accordance with the embodiments as described later. The implemented program code stored within the program code section 23, and the data stored within the stored data section 24 can be retrieved by the processor 21 whenever needed via the memory-processor coupling.

In some further embodiments the apparatus 10 can comprise a user interface 15. The user interface 15 can be coupled in some embodiments to the processor 21. In some embodiments the processor can control the operation of the user interface and receive inputs from the user interface 15. In some embodiments the user interface 15 can enable a user to input commands to the electronic device or apparatus 10, for example via a keypad, and/or to obtain information from the apparatus 10, for example via a display which is part of the user interface 15. The user interface 15 can in some embodiments comprise a touch screen or touch interface capable of both enabling information to be entered to the apparatus 10 and further displaying information to the user of the apparatus 10.

In some embodiments the apparatus further comprises a transceiver 13, the transceiver in such embodiments can be coupled to the processor and configured to enable a communication with other apparatus or electronic devices, for example via a wireless communications network. The transceiver 13 or any suitable transceiver or transmitter and/or receiver means can in some embodiments be configured to communicate with other electronic devices or apparatus via a wire or wired coupling.

The coupling can, as shown in FIG. 1, be the transmission channel 503. The transceiver 13 can communicate with further devices by any suitable known communications protocol, for example in some embodiments the transceiver 13 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

It is to be understood again that the structure of the apparatus 10 could be supplemented and varied in many ways.

Figure 3:
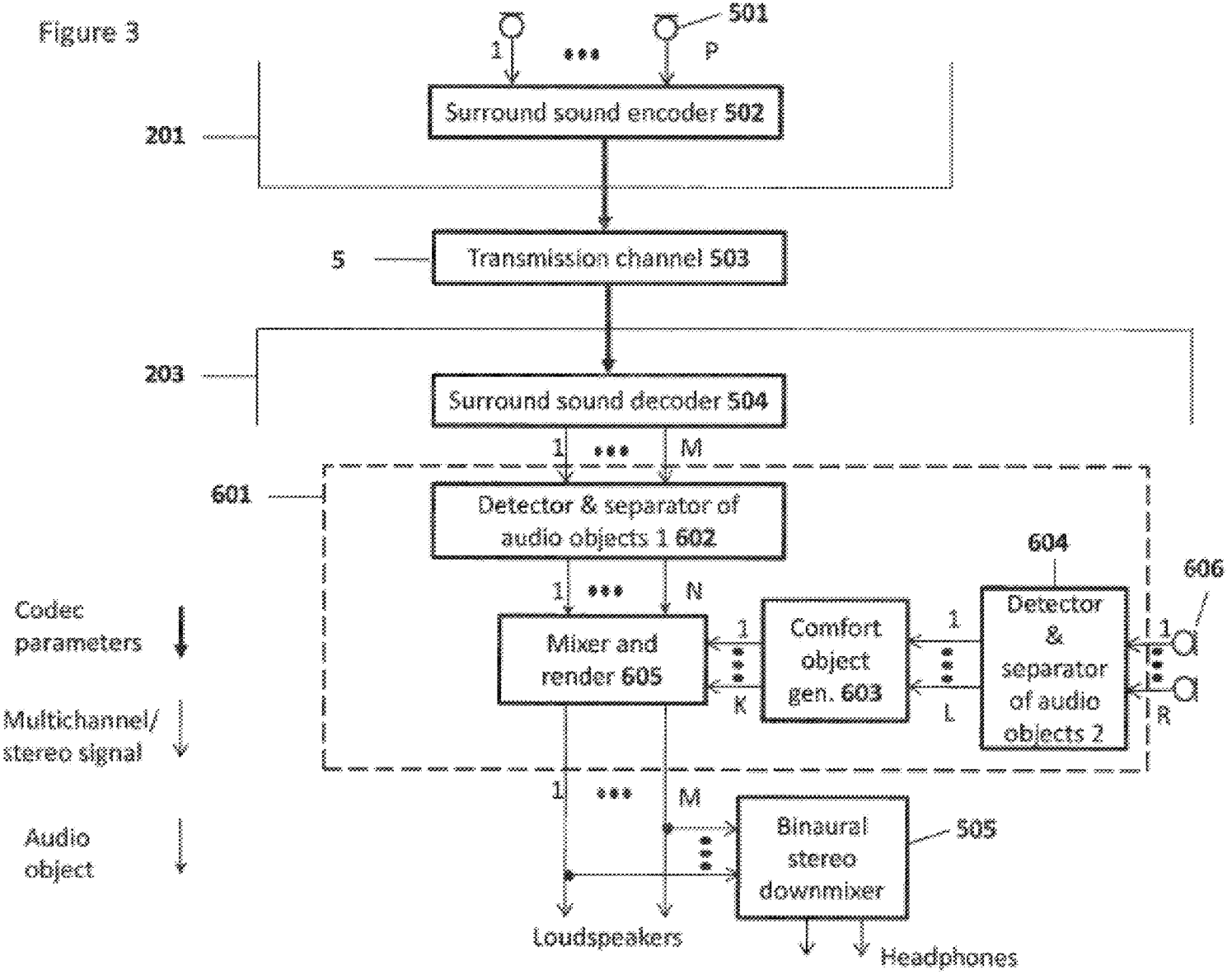
FIG. 3 shows schematically an audio signal processor for audio spatialisation and matched comfort audio signal generation according to some embodiments.

With respect to FIG. 3 a block diagram of a simplified telephony system comprising an audio signal processor for audio spatialisation and matched further or comfort audio signal generation is shown. Furthermore with respect to FIG. 4 a flow diagram showing the operation of the apparatus shown in FIG. 3 is shown.

The first, encoding or transmitting apparatus 201 is shown in FIG. 3 to comprise components similar to the first apparatus 1 shown in FIG. 1 comprising a microphone array of P microphones 501 which generate audio signals which are passed to the surround sound encoder 502.

The surround sound encoder 502 receives the audio signals generated by the microphone array of P microphones 501 and encodes the audio signals in any suitable manner.

The encoded audio signals are then passed over the transmission channel 503 to the second, decoding or receiving apparatus 203.

The second, decoding or receiving apparatus 203 comprises a surround sound decoder 504 which in a manner similar to the surround sound decoder shown in FIG. 1 decodes the encoded surround sound audio signals and generates a multi-channel audio signal, which is shown in FIG. 3, as a M channel audio signal. The decoded multichannel audio signal in some embodiments is passed to the audio signal processor 601 for audio spatialisation and matched further or comfort audio signal generation.

It is to be understood that the surround sound encoding and/or decoding blocks represent not only possible low-bitrate coding but also all necessary processing between different representations of the audio. This can include for example upmixing, downmixing, panning, adding or removing decorrelation etc.

The audio signal processor 601 for audio spatialisation and matched further or comfort audio signal generation may receive one multichannel audio representation from the surround sound decoder 504 and after the audio signal processor 601 for audio spatialisation and matched further or comfort audio signal generation there may also be other blocks that change the representation of the multichannel audio. For example there can be implemented in some embodiments a 5.1 channel to 7.1 channel converter, or a B-format encoding to 5.1 channel converter. In the example embodiment described herein the surround decoder 504 outputs the mid signal (M), the side signal (S) and the angles (alpha). The object separation is then performed on these signals. After the audio signal processor 601 for audio spatialisation and matched further or comfort audio signal generation in some embodiments there is a separate rendering block converting the signal to a suitable multichannel audio format, such as 5.1 channel format, 7.1 channel format or binaural format.

In some embodiments the receiving apparatus 203 further comprises an array of microphones 606. The array of microphones 606, which in the example shown in FIG. 3 comprises R microphones, can be configured to generate audio signals which are passed to the audio signal processor 601 for audio spatialisation and matched comfort audio signal generation.

In some embodiments the receiving apparatus 203 comprises an audio signal processor 601 for audio spatialisation and matched further or comfort audio signal generation. The audio signal processor 601 for audio spatialisation and further or matched comfort audio signal generation is configured to receive the decoded surround sound audio signals, which for example in FIG. 3 shows a M channel audio signal input to the audio signal processor 601 for audio spatialisation and matched further or comfort audio signal generation and further receive the local environmental generated audio signals from the receiving apparatus 203 microphone array 606 (R microphones). The audio signal processor 601 for audio spatialisation and matched comfort audio signal generation is configured to determine and separate audio sources or objects from these received audio signals, generate further or comfort audio objects (or audio sources) matching the audio sources or objects and mix and render the further or comfort audio objects or sources with the received audio signals and so to improve the intelligibility and quality of the surround sound audio signals. In the description herein the term audio object and audio source is interchangeable. Furthermore it would be understood that an audio object or audio source is at least a part of an audio signal, for example a parameterised section of the audio signal.

In some embodiments the audio signal processor 601 for audio spatialisation and matched comfort audio signal generation comprises a first audio signal analyser which is configured to analyse a first audio signal to determine or detect and separate audio objects or sources. The audio signal analyser or detector and separator are shown in the figures as detector and separator of audio objects 1, 602. The first detector and separator 602 are configured to receive the audio signals from the surround sound decoder 504 and generate parametric audio object representations from the multi-channel signal. It would be understood that the first detector and separator 602 output can be configured to output any suitable parametric representation of the audio. For example in some embodiments the first detector and separator 602 can for example be configured to determine sound sources and generate parameters describing for example the direction of each sound source, the distance of each sound source from the listener, the loudness of each sound source. In some embodiments the first detector and separator of audio objects 602 can be bypassed or be optional where surround sound decoder generates audio object representation of the spatial audio signals. In some embodiments the surround sound decoder 504 can be configured to output metadata indicating the parameters describing sound sources within the decoded audio signals such as the direction of sound sources, the distance and loudness then the audio object parameters can be passed directly to a mixer and renderer 605.

Figure 4:
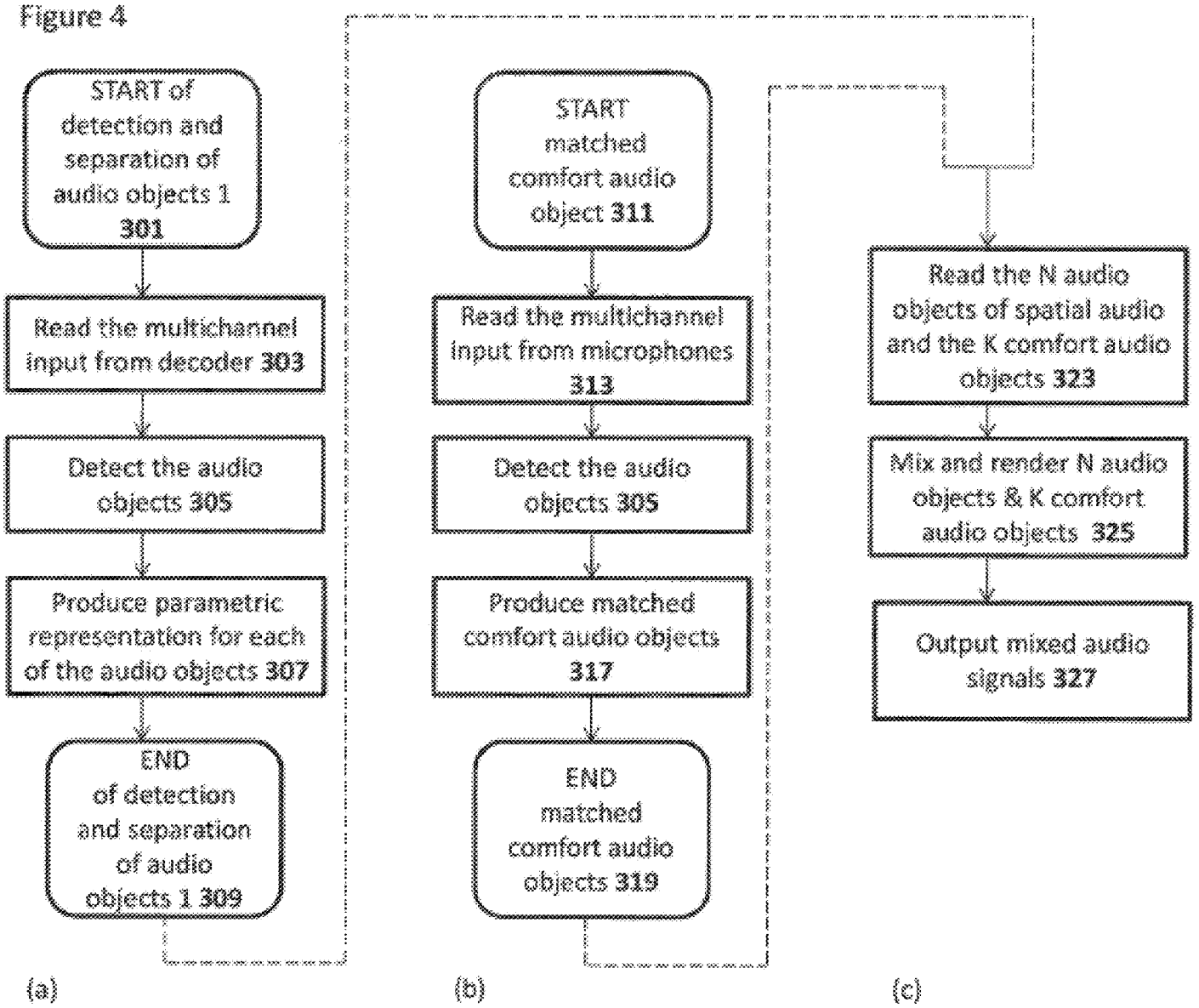
FIG. 4 shows a flow diagram of the operation of the audio signal processor as shown in FIG. 3 according to some embodiments.

With respect to FIG. 4 the operation of starting the detection and separation of audio objects from the surround sound decoder is shown in step 301.

Furthermore the operation of reading the multi-channel input from the sound decoder is shown in step 303.

In some embodiments the first detector and separator can determine audio sources from the spatial signal using any suitable means.

The operation of detecting audio objects within the surround sound decoder is shown in FIG. 4 by step 305.

The first detector and separator can in some embodiments then analyse the determined audio objects and determine parametric representations of the determined audio objects.

Furthermore the operation of producing parametric representations for each of the audio objects from the surround sound decoded audio signals is shown in FIG. 4 by step 307.

The first detector and separator can in some embodiments output these parameters to the mixer and renderer 605.

The generation an outputting of the parametric representation for each of the audio objects and the ending of the detection and separation of the audio objects from the surround sound decoder is shown in FIG. 4 by step 309.

In some embodiments the audio signal processor 601 for audio spatialisation and matched further or comfort audio signal generation comprises a second audio signal analyser (or means for analysing) or detector and separator of audio objects 2 604 which is configured to analyse a second audio signal in the form of the local audio signal from the microphone to determine or detect and separate audio objects or sources. In other words determining (detecting and separating) at least one localised audio source from at least one audio signal associated with a sound-field of the apparatus from the apparatus audio environment. The second audio signal analyser or detector and separator is shown in the figures as the detector and separator of audio objects 2 604. The second detector and separator 604, in some embodiments, is configured to receive the output of the microphone array 606 and generate parametric representations for the determined audio objects in a manner similar to the first detector and separator. In other words the second detector and separator can be considered to analyse the local or environmental audio scene to determine any localised audio sources or audio objects with respect to the listener or user of the apparatus.

The starting of the operation of generating matched comfort audio objects is shown in FIG. 4 by step 311.

The operation of reading the multi-channel input from the microphones 606 is shown in FIG. 4 by step 313.

The second detector and separator 604 can in some embodiments determine or detect audio objects from the multi-channel input from the microphones 606.

The detection of audio objects is shown in FIG. 4 by step 315.

The second detector and separator 604 can in some embodiments further be configured to perform a loudness threshold check on each of the detected audio objects to determine whether any of the objects have a loudness (or volume or power level) higher than a determined threshold value. Where the audio object detected has a loudness higher than a set threshold then the second detector and separator of audio objects 604 can be configured to generate a parametric representation for the audio object or source.

In some embodiments the threshold can be user controlled so that a sensitivity can be suitably adjusted for the local noise. In some embodiments the threshold can be used to automatically launch or trigger the generation of a comfort audio object. In other words the second detector and separator 604 can in some embodiments be configured to control the operation of the comfort audio object generator 603 such that where there are no "local" or "live" audio objects then no comfort audio objects are generated and the parameters from the surround sound decoder can be passed to the mixer and renderer with no additional audio sources to mix into the audio signal.

The second detector and separator 604 can furthermore in some embodiments be configured to output the parametric representations for the detected audio objects having a loudness higher than the threshold to the comfort audio object generator 603.

In some embodiments the second detector and separator 604 can be configured to receive a limit for the maximum number of live audio objects that the system will attempt to mask and/or a limit for the maximum number of comfort audio objects that the system will generate (in other words the values of L and K may be limited to below certain default values). These limits (which in some embodiments can be user controlled) prevent the system becoming overly active in very noisy surroundings and prevent too many comfort audio signals, that might reduce the user experience, being generated.

In some embodiments the audio signal processor 601 for audio spatialisation and matched comfort audio signal generation comprises a comfort (or further) audio object generator 603 or suitable means for generating further audio sources. The comfort audio object generator 603 receives the parameterised output from the detector and separator of audio objects 604 and generates matched comfort audio objects (or sources). The further audio sources which are generated are associated with the at least one audio source. For example in some embodiments as described herein the further audio sources are generated by means for selecting and/or generating from a range of further audio source types at least one further audio source most closely matching the at least one audio source; means for positioning the further audio source at a virtual location matching a virtual location of the at least one audio source; and means for processing the further audio source to match the at least one audio source spectra and/or time.

In other words that the generation of further (or comfort) audio sources (or objects) is in order to attempt to mask the effect produced by significant noise audio objects. It would be understood that the at least one further audio source associated with the at least one audio source is such that the at least one further audio source substantially masks the effect of the at least one audio source. However it would be understood that the term 'mask' or masking would include the actions such as substantially disguising, substantially incorporating, substantially adapting, or substantially camouflaging the at least one audio source.

The comfort audio object generator 603 can then output these comfort audio objects to the mixer and renderer 605. In the example shown in FIG. 3 there are K comfort audio objects generated.

The operation of producing matched comfort audio objects is shown in FIG. 4 by step 317.

The operation of ending the detection and separation of audio objects from the microphone array is shown in FIG. 4 by step 319.

In some embodiments the audio signal processor 601 for audio spatialisation and matched comfort audio signal generation comprises a mixer and renderer 605 configured to mix and render the decoded sound audio objects according to the received audio object parametric representations and the comfort audio object parametric representations.

The operation of reading or receiving the N audio objects and the K comfort audio objects is shown in FIG. 4 by step 323.

The operation of mixing and rendering the N audio objects and the K comfort audio objects is shown in FIG. 4 by step 325.

The operation of outputting the mixed and rendered N audio objects and K comfort audio objects is shown in FIG. 4 by step 327.

Furthermore in some embodiments, for example where the user is listening via noise isolating headphones, the mixer and renderer 605 can be configured to mix and render at least some of the live or microphone audio object audio signals so to allow the user to hear if there are any emergency or other situations in the local environment.

The mixer and renderer can then output the M multichannel signals to the loudspeakers or the binaural stereo downmixer 505.

In some embodiments the comfort noise generation can be used in combination with Active Noise Cancellation or other background noise reduction techniques. In other words the live noise is processed and active noise cancellation applied before the application of matched comfort audio signals to attempt to mask the background noise that remains audible after applying ANC. It is noted that in some embodiments not all of the noise in the background is masked intentionally. The benefit of this is that the user can still hear the events in the surrounding environment, such as car sounds on a street, and this is an important benefit from safety perspective for example while walking on a street.

Figure 5A:
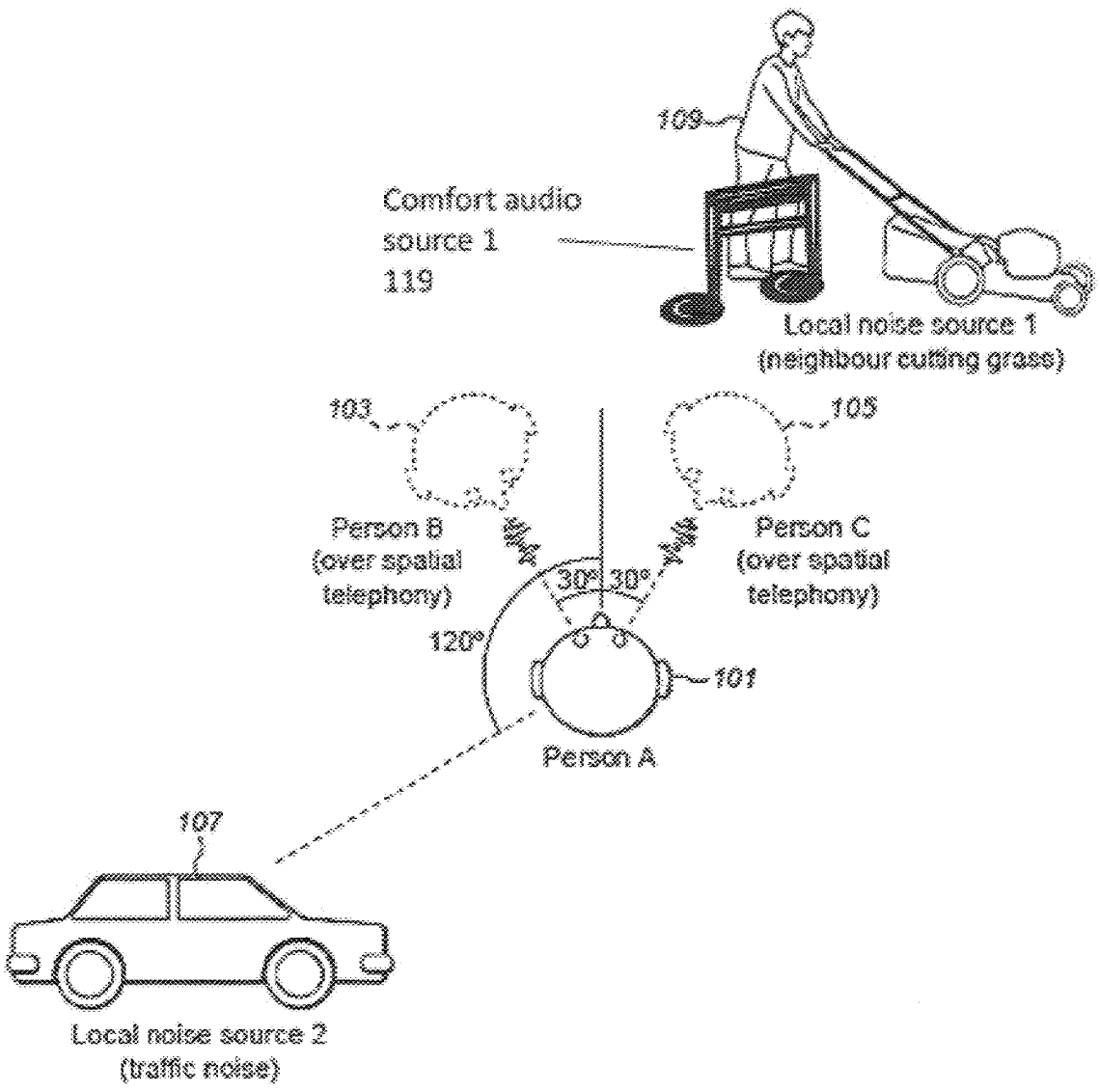
FIGS. 5*a* to 5*c* show examples of a conference call using the apparatus shown in FIGS. 3 and 4.
Figure 5B:
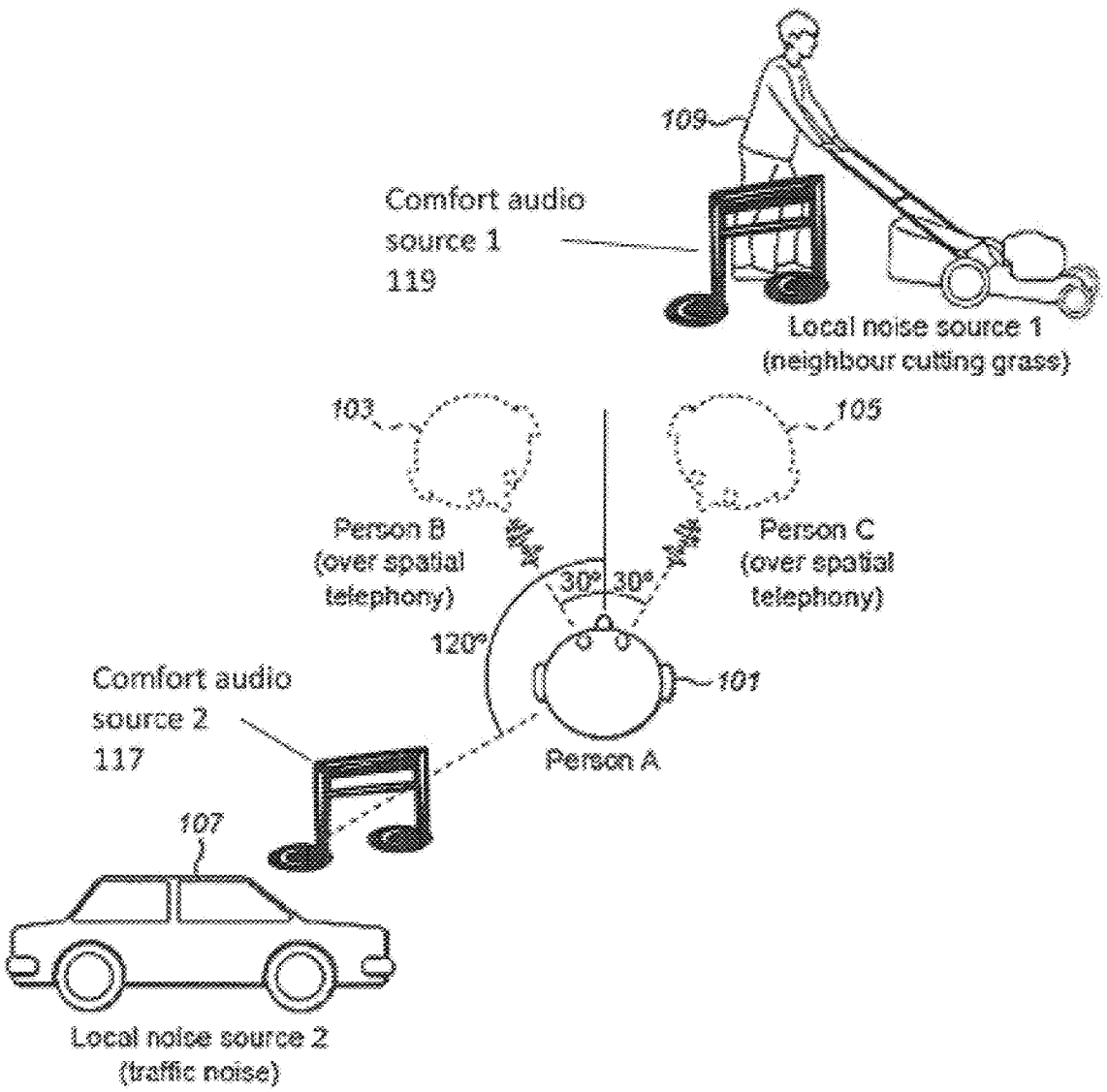
Figure 5C:
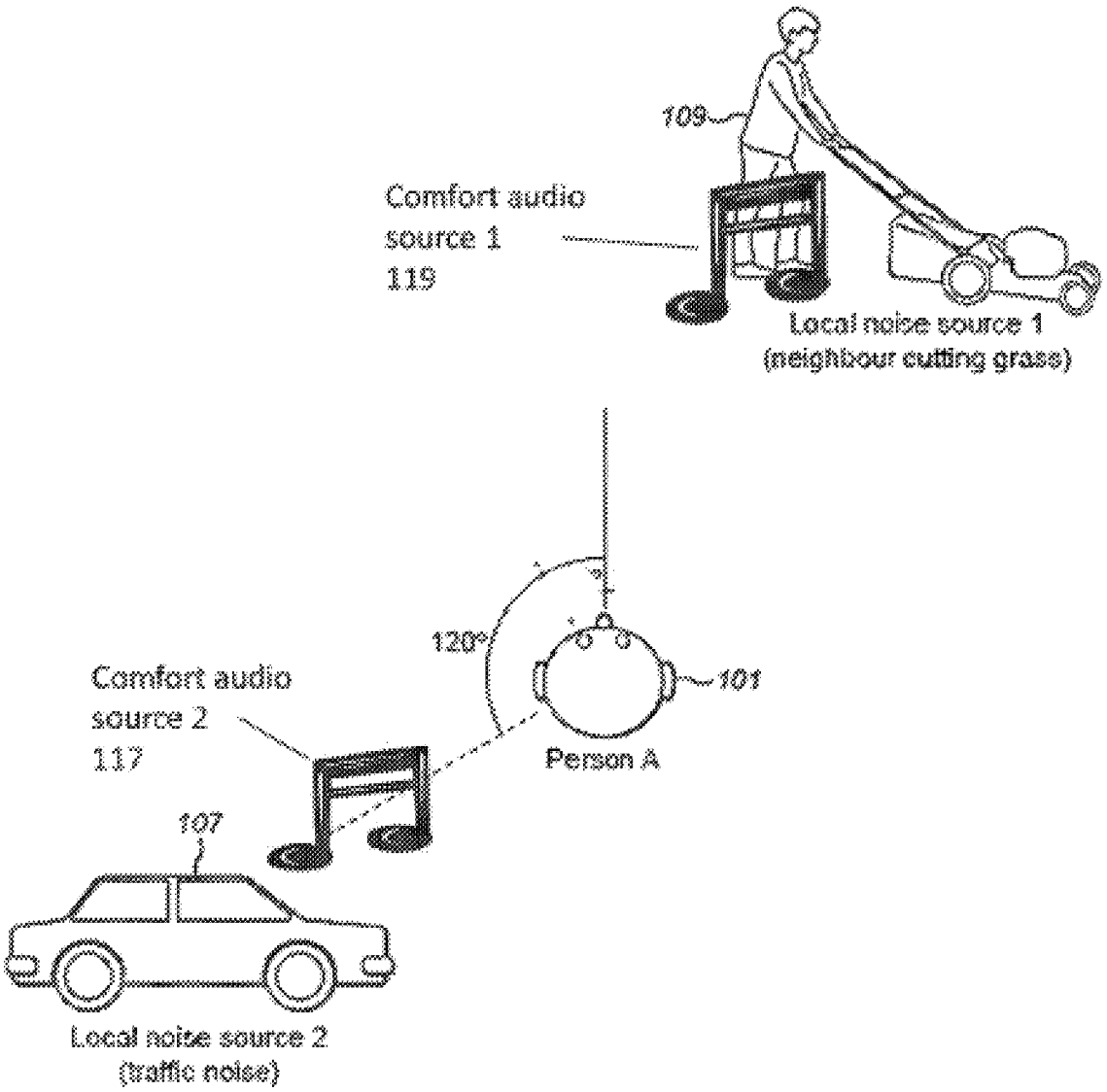

An example of the generating of matched comfort audio objects due to live or local noise is shown in FIGS. 5*a* to 5*c* where for example person A 101 is listening to the teleconference outputs from person B 103 and person C 105. With respect to FIG. 5*a* a first example is shown wherein the audio signal processor 601 for audio spatialisation and matched comfort audio signal generation generates a comfort audio source 1 119 which matches the local noise source 1 109 in order to attempt to mask the local noise source 1 109.

With respect to FIG. 5*b* a second example is shown where the audio signal processor 601 for audio spatialisation and matched further or comfort audio signal generation generates a comfort audio source 1 119 which matches the local noise source 1 109 in order to attempt to mask the local noise source 1 109 and a comfort audio source 2 117 which matches the local noise source 2 107 in order to attempt to mask the local noise source 2 107.

With respect to FIG. 5*c* a third example is shown where the user of the apparatus, person A 101 is listening to an audio signal or source generated by the apparatus, for example playing back music on the apparatus and the audio signal processor 601 for audio spatialisation and matched further or comfort audio signal generation generates a further or comfort audio source 1 119 which matches the local noise source 1 109 in order to attempt to mask the local noise source 1 109 and a further or comfort audio source 2 117 which matches the local noise source 2 107 in order to attempt to mask the local noise source 2 107. In such embodiments the audio signal or source generated by the apparatus can be used to generate the matching further or comfort audio objects. It would be understood that FIG. 5*c* shows that in some embodiments further or comfort audio objects can be generated and applied when a telephony call (or use of any other service) is not taking place. In this example audio stored locally in the device or apparatus, for example in a file or in a CD, is listened to, and the listening apparatus does not need to be connected or coupled to any service or other apparatus. Thus for example the addition of further or comfort audio objects can be applied as a standalone feature to mask disturbing live background noises. In other words in the case when the user is not listening to music or any other audio signal with the device (besides the comfort audio). The embodiments can thus be used in any apparatus able to play spatial audio for the user (to mask the live background noise).

Figure 7:
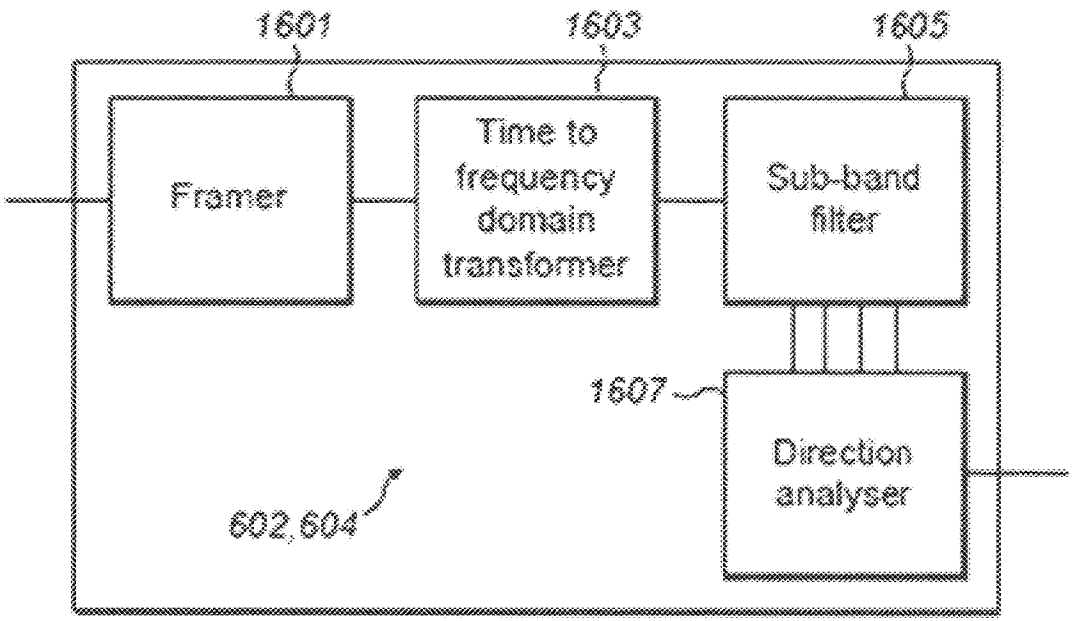
FIG. 7 shows schematically an audio spatialiser as shown in FIG. 3 according to some embodiments.

With respect to FIG. 7 an example implementation of the object detector and separator, such as the first and the second object detector and separator according to some embodiments is shown. Furthermore with respect to FIG. 10 the operation of the example object detector and separator as shown in FIG. 7 is described.

In some embodiments the object detector and separator comprises a framer 1601. The framer 1601 or suitable framer means can be configured to receive the audio signals from the microphones/decoder and divide the digital format signals into frames or groups of audio sample data. In some embodiments the framer 1601 can furthermore be configured to window the data using any suitable windowing function. The framer 1601 can be configured to generate frames of audio signal data for each microphone input wherein the length of each frame and a degree of overlap of each frame can be any suitable value. For example in some embodiments each audio frame is 20 milliseconds long and has an overlap of 10 milliseconds between frames. The framer 1601 can be configured to output the frame audio data to a Time-to-Frequency Domain Transformer 1603.

Figure 10:
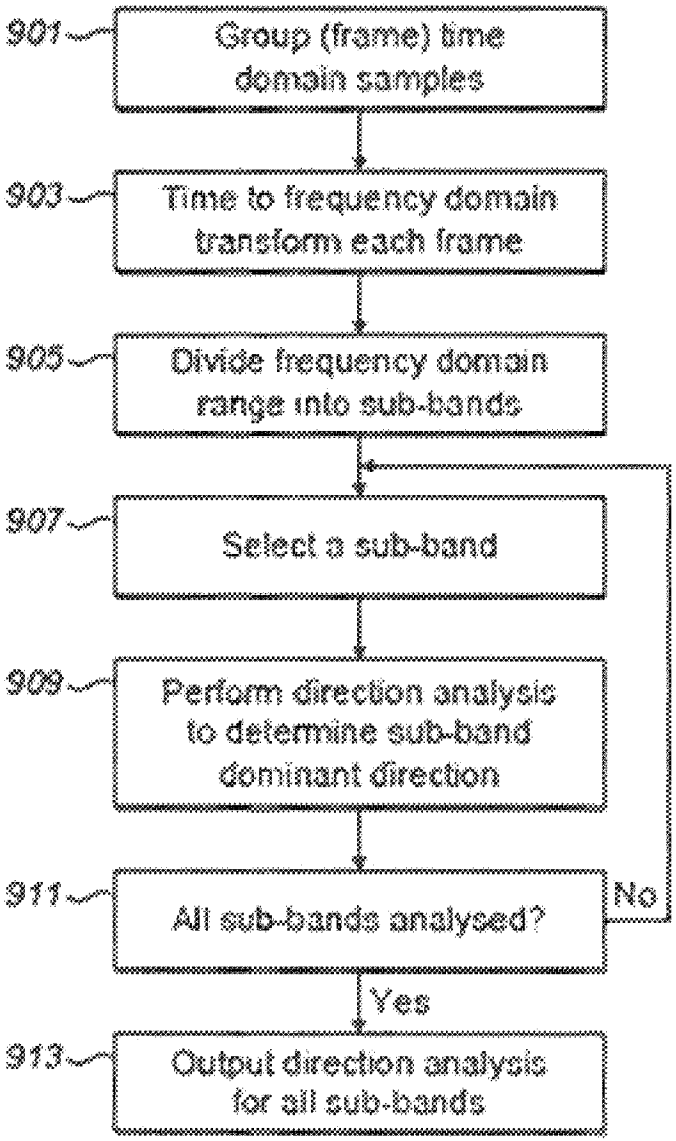
FIG. 10 shows a flow diagram of the operation of the audio spatialiser as shown in FIG. 7 according to some embodiments.

The operation of grouping or framing time domain samples is shown in FIG. 10 by step 901.

In some embodiments the object detector and separator is configured to comprise a Time-to-Frequency Domain Transformer 1603. The Time-to-Frequency Domain Transformer 1603 or suitable transformer means can be configured to perform any suitable time-to-frequency domain transformation on the frame audio data. In some embodiments the Time-to-Frequency Domain Transformer can be a Discrete Fourier Transformer (DFT). However the Transformer can be any suitable Transformer such as a Discrete Cosine Transformer (DCT), a Modified Discrete Cosine Transformer (MDCT), a Fast Fourier Transformer (FFT) or a quadrature mirror filter (QMF). The Time-to-Frequency Domain Transformer 1603 can be configured to output a frequency domain signal for each microphone input to a sub-band filter 1605.

The operation of transforming each signal from the microphones into a frequency domain, which can include framing the audio data, is shown in FIG. 10 by step 903.

In some embodiments the object detector and separator comprises a sub-band filter 1605. The sub-band filter 1605 or suitable means can be configured to receive the frequency domain signals from the Time-to-Frequency Domain Transformer 1603 for each microphone and divide each microphone audio signal frequency domain signal into a number of sub-bands.

The sub-band division can be any suitable sub-band division. For example in some embodiments the sub-band filter 1605 can be configured to operate using psychoacoustic filtering bands. The sub-band filter 1605 can then be configured to output each domain range sub-band to a direction analyser 1607.

The operation of dividing the frequency domain range into a number of sub-bands for each audio signal is shown in FIG. 10 by step 905.

In some embodiments the object detector and separator can comprise a direction analyser 1607. The direction analyser 1607 or suitable means can in some embodiments be configured to select a sub-band and the associated frequency domain signals for each microphone of the sub-band.

The operation of selecting a sub-band is shown in FIG. 10 by step 907.

The direction analyser 1607 can then be configured to perform directional analysis on the signals in the sub-band. The directional analyser 1607 can be configured in some embodiments to perform a cross correlation between the microphone/decoder sub-band frequency domain signals within a suitable processing means.

In the direction analyser 1607 the delay value of the cross correlation is found which maximises the cross correlation of the frequency domain sub-band signals. This delay can in some embodiments be used to estimate the angle or represent the angle from the dominant audio signal source for the sub-band. This angle can be defined as $\alpha$. It would be understood that whilst a pair or two microphones/decoder channels can provide a first angle, an improved directional estimate can be produced by using more than two microphones/decoder channels and preferably in some embodiments more than two microphones/decoder channels on two or more axes.

The operation of performing a directional analysis on the signals in the sub-band is shown in FIG. 10 by step 909.

The directional analyser 1607 can then be configured to determine whether or not all of the sub-bands have been selected.

The operation of determining whether all the sub-bands have been selected is shown in FIG. 10 by step 911.

Where all of the sub-bands have been selected in some embodiments then the direction analyser 1607 can be configured to output the directional analysis results.

The operation of outputting the directional analysis results is shown in FIG. 10 by step 913.

Where not all of the sub-bands have been selected then the operation can be passed back to selecting a further sub-band processing step.

The above describes a direction analyser performing an analysis using frequency domain correlation values. However it would be understood that the object detector and separator can perform directional analysis using any suitable method. For example in some embodiments the object detector and separator can be configured to output specific azimuth-elevation values rather than maximum correlation delay values. Furthermore in some embodiments the spatial analysis can be performed in the time domain.

In some embodiments this direction analysis can therefore be defined as receiving the audio sub-band data;

$$X_k^b(n)=X_k(n_b+n),\ n=0,\ldots,n_{b+1}-n_b-1,\ b=0,\ldots,B-1$$

where $n_b$ is the first index of bth subband. In some embodiments for every subband the directional analysis as described herein as follows. First the direction is estimated with two channels. The direction analyser finds delay $\tau_b$ that maximizes the correlation between the two channels for subband b. DFT domain representation of e.g. $X_k^b(n)$ can be shifted $\tau_b$ time domain samples using $$X_{k,\tau_b}^b(n) = X_k^b(n)e^{-j\frac{2\pi n\tau_b}{N}}.$$

The optimal delay in some embodiments can be obtained from $$\max_{\tau_b}\mathrm{Re}\left(\sum_{n=0}^{n_{b+1}-n_b-1}\left(X_{2,\tau_b}^b(n)^* X_3^b(n)\right)\right),\ \tau_b \in [-D_{tot}, D_{tot}]$$

where Re indicates the real part of the result and * denotes complex conjugate. $X_{2,\tau_b}^b$ and $X_3^b$ are considered vectors with length of $n_{b+1}-n_b$ samples and $D_{tot}$ corresponds to the maximum delay in samples between the microphones. In other words where the maximum distance between two microphones is d, then D_tot=d*Fs/v, where v is the speed of sound in air (m/s) and Fs is sampling rate (Hz). The direction analyser can in some embodiments implement a resolution of one time domain sample for the search of the delay.

In some embodiments the object detector and separator can be configured to generate a sum signal. The sum signal can be mathematically defined as.

$$X_{sum}^{b} = \begin{cases} \left(X_{2,\tau_b}^{b} + X_3^{b}\right)/2 & \tau_b \le 0 \\ \left(X_2^{b} + X_{3,-\tau_b}^{b}\right)/2 & \tau_b > 0 \end{cases}$$

In other words the object detector and separator is configured to generate a sum signal where the content of the channel in which an event occurs first is added with no modification, whereas the channel in which the event occurs later is shifted to obtain best match to the first channel.

It would be understood that the delay or shift $\tau_b$ indicates how much closer the sound source is to one microphone (or channel) than another microphone (or channel). The direction analyser can be configured to determine actual difference in distance as $$\Delta_{23} = \frac{v\tau_b}{F_s}$$

where Fs is the sampling rate of the signal (Hz) and v is the speed of the signal in air (m/s) (or in water if we are making underwater recordings).

The angle of the arriving sound is determined by the direction analyser as, $$\dot{\alpha}_b \pm \cos^{-1}\left(\frac{\Delta_{23}^{2} + 2b\Delta_{23} - d^2}{2db}\right)$$

where d is the distance between the pair of microphones/channel separation (m) and b is the estimated distance between sound sources and nearest microphone. In some embodiments the direction analyser can be configured to set the value of b to a fixed value. For example b=2 meters has been found to provide stable results.

It would be understood that the determination described herein provides two alternatives for the direction of the arriving sound as the exact direction cannot be determined with only two microphones/channels.

In some embodiments the object detector and separator can be configured to use audio signals from a third channel or the third microphone to define which of the signs in the determination is correct. The distances between the third channel or microphone and the two estimated sound sources are:

$$\delta_b^{+} = \sqrt{(h + b\sin(\dot{\alpha}_b))^2 + (d/2 + b\cos(\dot{\alpha}_b))^2}$$

$$\delta_b^{-} = \sqrt{(h - b\sin(\dot{\alpha}_b))^2 + (d/2 + b\cos(\dot{\alpha}_b))^2}$$

where h is the height of an equilateral triangle (m) (where the channels or microphones determine a triangle), i.e.

$$h = \frac{\sqrt{3}}{2}d.$$

The distances in the above determination can be considered to be equal to delays (in samples) of;

$$\tau_b^{+} = \frac{\delta^{+} - b}{v}F_s$$

-continued $$\tau_b^{-} = \frac{\delta^{-} - b}{v}F_s$$

Out of these two delays the object detector and separator in some embodiments is configured to select the one which provides better correlation with the sum signal. The correlations can for example be represented as $$c_b^{+} = \mathrm{Re}\left(\sum_{n=0}^{n_{b+1}-n_b-1} \left(X_{sum,\tau_b^{+}}^{b}(n)^{*} X_1^{b}(n)\right)\right)$$

$$c_b^{-} = \mathrm{Re}\left(\sum_{n=0}^{n_{b+1}-n_b-1} \left(X_{sum,\tau_b^{-}}^{b}(n)^{*} X_1^{b}(n)\right)\right)$$

The object detector and separator can then in some embodiments then determine the direction of the dominant sound source for subband b as:

$$\alpha_b = \begin{cases} \dot{\alpha}_b & c_b^{+} \ge c_b^{-} \\ -\dot{\alpha}_b & c_b^{+} < c_b^{-} \end{cases}.$$

In some embodiments the object detector and separator further comprises a mid/side signal generator. The main content in the mid signal is the dominant sound source found from the directional analysis. Similarly the side signal contains the other parts or ambient audio from the generated audio signals. In some embodiments the mid/side signal generator can determine the mid M and side S signals for the sub-band according to the following equations:

$$M^{b} = \begin{cases} \left(X_{2,\tau_b}^{b} + X_3^{b}\right)/2 & \tau_b \le 0 \\ \left(X_2^{b} + X_{3,-\tau_b}^{b}\right)/2 & \tau_b > 0 \end{cases}$$

$$S^{b} = \begin{cases} \left(X_{2,\tau_b}^{b} - X_3^{b}\right)/2 & \tau_b \le 0 \\ \left(X_2^{b} - X_{3,-\tau_b}^{b}\right)/2 & \tau_b > 0 \end{cases}$$

It is noted that the mid signal M is the same signal that was already determined previously and in some embodiments the mid signal can be obtained as part of the direction analysis. The mid and side signals can be constructed in a perceptually safe manner such that the signal in which an event occurs first is not shifted in the delay alignment. The mid and side signals can be determined in such a manner in some embodiments is suitable where the microphones are relatively close to each other. Where the distance between the microphones is significant in relation to the distance to the sound source then the mid/side signal generator can be configured to perform a modified mid and side signal determination where the channel is always modified to provide a best match with the main channel.

Figure 8:
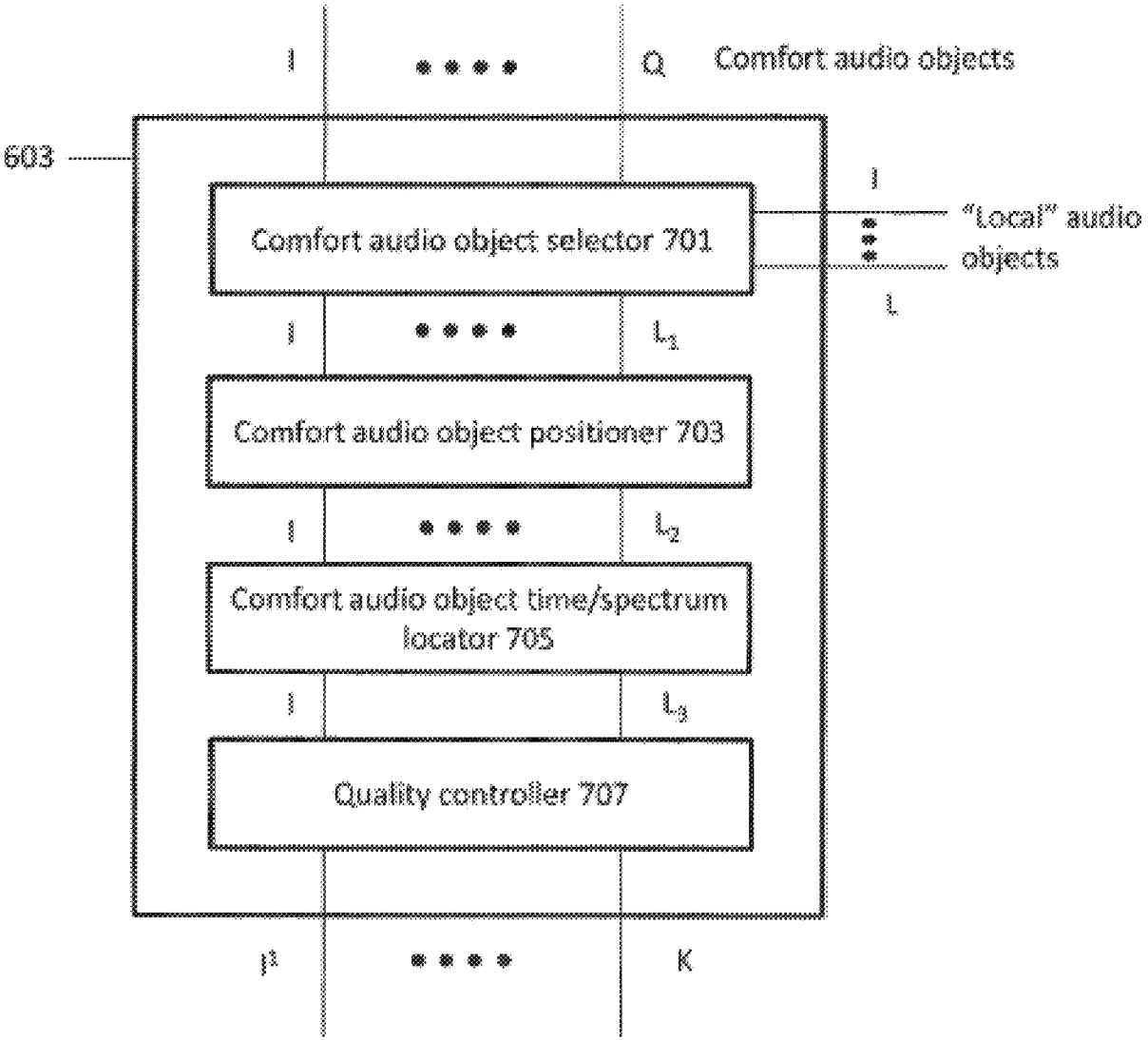
FIG. 8 shows schematically a matched comfort audio signal generator as shown in FIG. 3 according to some embodiments.

With respect to FIG. 8 an example comfort audio object generator 603 is shown in further detail. Furthermore with respect to FIG. 11 the operation of the comfort audio object generator is shown.

In some embodiments the comfort audio object generator 603 comprises a comfort audio object selector 701. The comfort audio object selector 701 can in some embodiments be configured to receive or read the live audio objects, in other words the audio objects from the detector and separator of audio objects 2 604.

Figure 11:
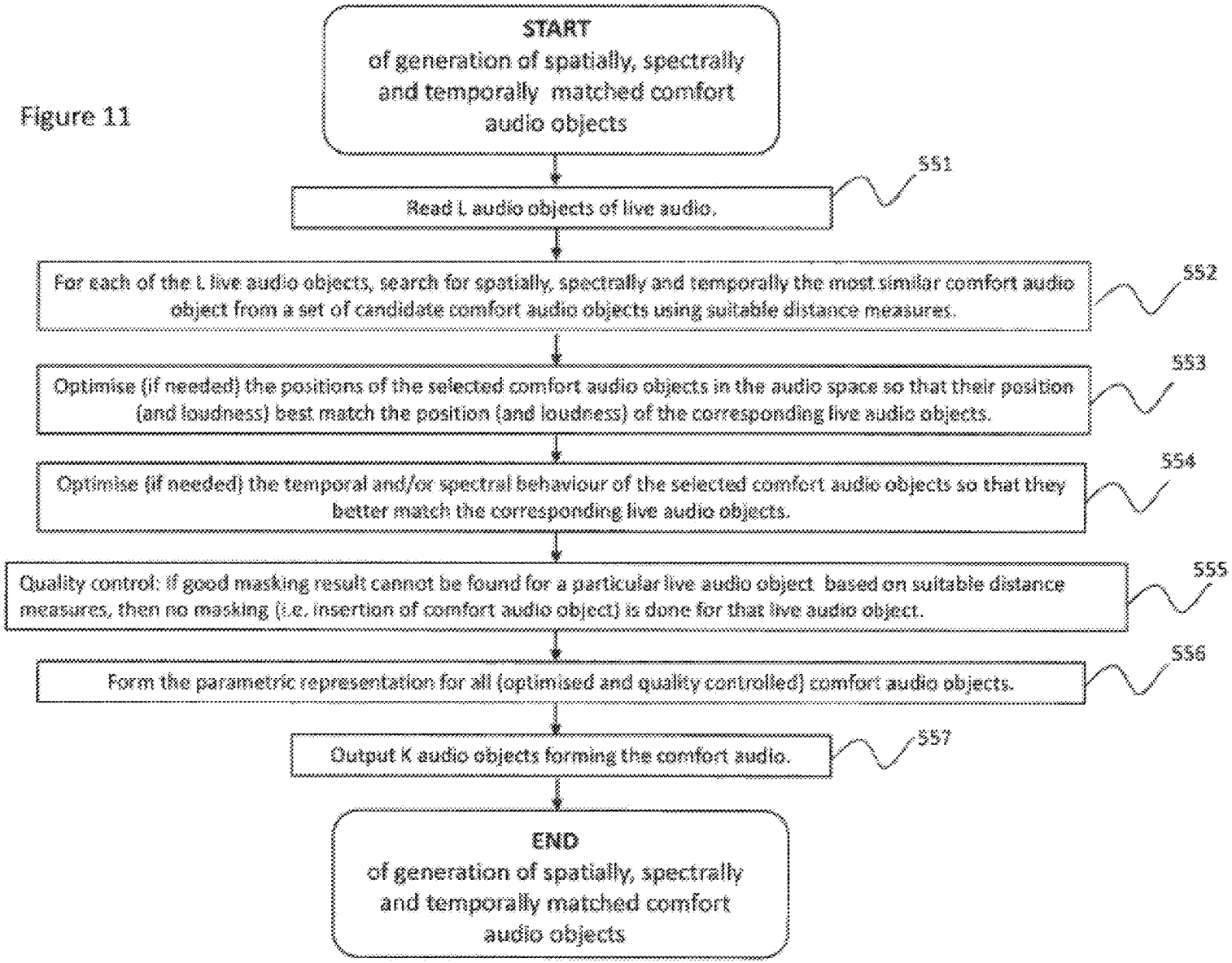
FIG. 11 shows a flow diagram of the operation of the matched comfort audio signal generator as shown in FIG. 8.

The operation of reading the L audio objects of live audio is shown in FIG. 11 by step 551.

The comfort audio objects selector can furthermore in some embodiments receive a number of potential or candidate further or comfort audio objects. It would be understood that a (potential or candidate) further or comfort audio object or audio source is an audio signal or part of an audio signal, track or clip. In the example shown in FIG. 8 there are Q candidate comfort audio objects numbered 1 to Q available. However it would be understood that in some embodiments the further or comfort audio objects or sources are not predetermined or pregenerated but are determined or generated directly based on the audio objects or audio sources extracted from the live audio.

The comfort audio object (or source) selector 701 can for each of the local audio objects (or sources) search for the most similar comfort audio object (or source) with regards to spatial, spectral and temporal values from the set of candidate comfort audio objects using a suitable search, error or distance measure. For example in some embodiments each of the comfort audio objects has a determined spectral and temporal parameter which can be compared against the temporal and spectral parameter or element of the local or live audio object. A difference measure or error value can in some embodiments be determined for each candidate comfort audio object and the live audio object and the comfort audio object with the closest spectral and temporal parameters, in other words with the minimum distance or error is selected.

Figure 9:
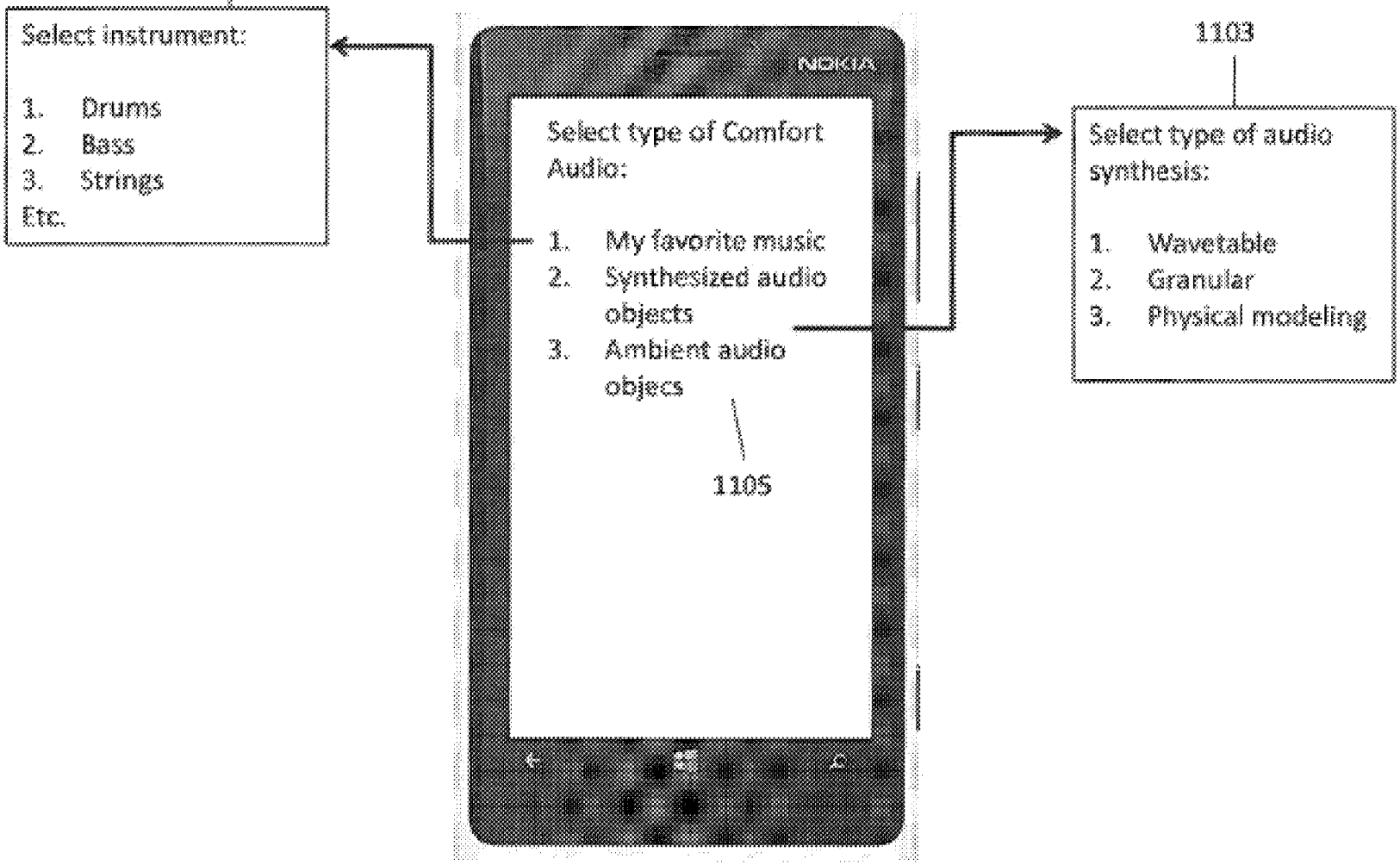
FIG. 9 shows schematically a user interface input menu for selecting a type of comfort audio signal according to some embodiments.

In some embodiments the candidate audio sources used for candidate comfort audio objects can be determined manually by use of a user interface. With respect to FIG. 9 an example user interface selection of comfort audio menus can be shown wherein the main menu shows a first selection type of favourite music which can for example be subdivided by the sub-menu 1101 into options 1. Drums, 2. Bass, and 3. Strings, a second selection type of synthesised audio objects which can for example be sub-divided as shown in sub-menu 1103 showing the examples of 1. Wavetable, 2. Granular, and 3, Physical modelling, and a third selection of ambient audio objects 1105.

The set of candidate comfort audio objects used in the search can in some embodiments be obtained by performing audio object detection for a set of input audio files. For example the audio object detection can be applied to a set of favourite tracks of the user. As described herein in some embodiments the candidate comfort audio objects can be synthesised sounds. The candidate comfort audio objects to be used at a particular time can in some embodiments be taken from a single piece of music belonging to a favourite track of the user. However, as described herein the audio objects can be repositioned to match the directions of the audio objects of the live noise or may be otherwise modified as explained herein. In some embodiments a subset of the audio objects can be repositioned while others can remain in the positions as they are in the original piece of music. Furthermore in some embodiments only a subset of all the objects of a musical piece may be used as the comfort audio where not all of the objects are needed for the masking. In some embodiments a single audio object corresponding to a single music instrument can be used as comfort audio object.

In some embodiments the set of comfort audio objects can change over time. For example when a piece of music has been played through as comfort audio, a new set of comfort audio objects are selected from the next piece of music and are suitably positioned into the audio space to best match the live audio objects.

In case the live audio object to be masked is someone speaking to his phone in the background, the best matching audio object might e.g. be a woodwind or brass instrument from the music piece.

The selection of suitable comfort audio objects is generally known. For example, in some embodiments the comfort audio object is a white noise sound as white noise has been found effective as a masking object as it is broadband and hence it effectively masks sounds across a wide audio spectrum.

To find the spectrally best matching comfort audio object, various spectral distortion and distance measures can be used in some embodiments. For example in some embodiments a spectral distance metric could be the log-spectral distance defined as:

$$D_{LS} = \sqrt{\frac{1}{2\pi}\int_{-\pi}^{\pi}\left[10\log_{10}\frac{P(\omega)}{S(\omega)}\right]^2 d\omega}$$

where ω is normalized frequency with ranging from −π to π (with π being one-half of the sampling frequency), and P(ω) and S(ω) the spectra of a live audio object and a candidate comfort audio object, respectively.

In some embodiments the spectral matching can be performed by measuring the Euclidean distance between the mel-cepstrum of the live audio object and the candidate comfort audio object.

As a further example, the comfort audio objects may be selected based on their ability to perform spectral masking based on any suitable masking model. For example the masking models used in conventional audio codecs, such as in Advanced Audio Coding (AAC), may be used. Thus for example the comfort audio object which most effectively masks the current live audio object based on some spectral masking model may be selected as the comfort audio object.

In such embodiments where the audio objects are sufficiently long, the temporal evolution of the spectrum could be taken into account when doing the matching. For example in some embodiments dynamic time warping can be applied to calculate a distortion measure over the mel-cepstra of the live audio object and the candidate music audio object. As another example the Kullback-Leibler divergence can be used between Gaussians fitted to the mel-cepstra of the live audio object and the candidate music audio object.

In some embodiments as described herein the candidate comfort audio objects are synthesized further or comfort audio objects. In such embodiments any suitable synthesis can be applied such as wavetable synthesis, granular synthesis, or physical modelling based synthesis. To ensure the spectral similarity of the synthesized comfort audio object in some embodiments the comfort audio object selector can be configured to adjust the synthesizer parameters such that the spectrum of the synthesized sound matches that of the live audio object to be masked. In some embodiments the comfort audio object candidates are a large variety of generated synthesized sounds which are evaluated using spectral distortion measures as described herein to find matches where the spectral distortion falls below a threshold.

In some embodiments the further or comfort audio object selector is configured to select the comfort audio such that the combination of further or comfort audio and live background noise will be pleasing.

Furthermore it would be understood that in some embodiments the second audio signal can be a 'recorded' audio signal (rather than a 'live' signal) which the user wishes to mix with the first audio signal. In such embodiments the second audio signal contains a noise source which the user wishes to remove. For example in some embodiments the second audio signal can be a 'recorded' audio signal of a countryside or rural environment which contains a noise audio source (such as for example an aeroplane passing overhead) which the user wishes to combine with a first audio signal (such as a telephone call). In some embodiments the apparatus, and in particularly the comfort object generator, can generate a suitable further audio source to substantially mask the noise of the aeroplane, while the other rural audio signals are combined with the telephone call.

In some embodiments the evaluation of the combination of comfort audio and live background noise can be performed by analysing the spectral, temporal, or directional characteristics of the candidate masking audio object and the audio object to be masked together.

In some embodiments the Discrete Fourier Transform (DFT) can be used to analyse the tone-likeness of an audio object. The frequency of a sinusoid can be estimated as $$\omega^* = \arg\left\{\max_{\omega}|DTFT(\omega)|\right\}.$$

That is, the sinusoidal frequency estimate may be obtained as the frequency which maximizes the DTFT magnitude. Furthermore in some embodiments the tone-like nature of the audio object can be a detected or determined by comparing the magnitude corresponding to the maximum peak of the DFT, that is, $$\max_{\omega}|DTFT(\omega)|,$$

against the average DFT magnitude outside the peak. That is, if there is a maximum in the DFT which is significantly larger than the average DFT magnitude outside the maximum, the signal may have a high likelihood of being tone-like. Correspondingly, if the maximum value of the DFT is significantly close to the average DFT value, the detection step may decide that the signal is not tone-like (there are no narrow frequency components which would be strong enough).

For example, if the ratio of the maximum peak magnitude to the average magnitude is over 10, the signal might be determined tone-like (or tonal). Thus for example the live audio object to be masked is a near sinusoidal signal with frequency of 800 Hz. In this case, the system may synthesize two additional sinusoids, one with frequency 200 Hz and another with frequency 400 Hz to act as comfort sounds. In this case, the combination of these sinusoidals creates a musical chord having a fundamental frequency of 200 Hz which is more pleasing to listen than a single sinusoid.

In general, the principle of positing or repositioning a comfort audio objects can be that the resulting downmixed combinations of sounds from the comfort audio object and the live audio object are consonant rather than dissonant. For example, where both the comfort sound object and the live audio or noise object have tonal components, the noises audio object can be matched in musically preferred ratios. For example, octave, unison, perfect fourth, perfect fifth, major third, minor sixth, minor third, or major sixth ratios between two harmonic sounds would be preferred over other ratios. In some embodiments the matching could be done, for example, by performing fundamental frequency (FO) estimation for the comfort audio objects and live audio (noise) objects, and selecting the pairs to be matched so that the combinations are in consonant ratios rather than dissonant ratios.

In some embodiments in addition to harmonic pleasantness, the comfort audio object selector 701 can be configured to attempt to make the combinations of comfort audio objects and noise objects rhythmically pleasant. For example in some embodiments the selector can be configured to select the comfort audio objects such that they are in rhythmic relations to the noise objects. For example, assuming the noise object contains a detectable pulse with tempo t, the comfort audio object may be selected as one that contains a detectable pulse which is an integer multiple (e.g. 2t. 3t, 4t, or 8t) of the noise pulse. Alternatively in some embodiments the comfort audio signal can be selected as one containing a pulse which is an integer fraction of the noise pulse (e.g. ½t, ¼t, ⅛t, 1/16t). Any suitable methods for tempo and beat analysis can be used for determining the pulse period, and then aligning the comfort audio and noise signals so that their detected beats match. After the tempo has been obtained, the beat times can be analysed using any suitable method. In some embodiments the input to the beat tracking step is the estimated beat period and the accent signal computed during the tempo estimation phase.

The operation of searching for spatial, spectral and temporal similar comfort audio objects from a set of the candidate comfort audio objects using a suitable distance measure for each of the L live audio objects is shown in FIG. 11 by step 552.

In some embodiments the comfort audio objects sector 701 can then output a first version of comfort audio objects associated with the received live audio objects (shown as 1 to $L_1$ comfort audio objects).

In some embodiments the comfort audio object generator 603 comprises a comfort audio object positioner 703. The comfort audio object positioner 703 is configured to receive the comfort audio objects 1 to $L_1$ generated from the comfort audio object generator 701 with respect to each of the local audio objects and positions the comfort audio object at the location of the associated local audio object. Furthermore in some embodiments the comfort audio object positioner 703 can be configured to modify or process the loudness (or sets the volume or power) of the comfort audio object such that the loudness best matches the loudness of the corresponding live audio object.

The comfort audio object position at 703 can then output the position and comfort audio object to a comfort audio object time/spectrum locator 705.

The operation of setting the position and/or loudness of the comfort audio objects to best match the position and/or loudness of the corresponding applied audio objects is shown in FIG. 11 by step 553.

In some embodiments the comfort audio object generator comprises a comfort audio object time/spectrum locator 705. The comfort audio object time/spectrum locator 705 can be configured to receive the position and comfort audio object output from the comfort audio object positioner 703 and attempt to process the position and comfort audio object such that the temporal and/or spectral behaviour of the selected positioned comfort audio objects better matches the corresponding live audio object.

The operation of processing the comfort audio object to better match the corresponding lives audio object in terms of temporal and/or spectral behaviour is shown in FIG. 11 by step 554.

In some embodiments the comfort audio object generator comprises a quality controller 707. The quality controller 707 can be configured to receive the processed comfort audio objects from the comfort audio object time/spectrum locator 705 and determine whether a good masking result has been found for a particular live audio object. The masking effect can in some embodiments be determined based on a suitable distance measure between the comfort audio object and the live audio object. Where the quality controller 707 determines that the distance measure is too large (in other words the error between the comfort audio object and the live audio object is significant) then the quality controller removes or nullifies the comfort audio object.

In some embodiments the quality controller can be configured to analyse the success of the comfort audio object generation in masking noise and attempting to make the remaining noise less annoying. This can for example be implemented in some embodiments by comparing the audio signal after adding the comfort audio objects to the audio signal to the audio signal before adding the comfort audio objects, and analysing whether the signal with the comfort audio objects is more pleasing to a user based on some computational audio quality metric. For example a psychoacoustic auditory masking model could be employed to analyse the effectiveness of the added comfort audio objects to mask the noise sources.

In some embodiments computational models of noise annoyance can be generated to compare whether the noise annoyance is larger before or after adding the comfort audio objects. Where adding the comfort audio objects is not effective in masking the live audio objects or noise sources or making them less disturbing, the quality controller 707 can be configured in some embodiments to:

- switch the generation and addition of comfort audio sources off, meaning that no comfort audio sources are added;
- apply conventional ANC to mask the noise; or
- request an input from the user whether they wish to keep the comfort audio source masking mode on or to resort to the conventional ANC.

The operation of performing a quality control on the comfort audio object is shown in FIG. 11 by step 555.

In some embodiments the quality controller then forms a parametric representation of the comfort audio objects. This can in some embodiments the one of combining the comfort audio objects in a suitable format or combining the audio objects to form a suitable mid and side signal representation for the whole comfort audio object group.

The operation of forming the parametric representation is shown in FIG. 11 by step 556.

In some embodiments the parametric representation is then output in the form of outputting K audio objects forming the comfort audio.

The outputting of the K comfort audio objects is shown in FIG. 11 by step 557.

In some embodiments the user can give indication where he would like a masking sound to be positioned (or where the most annoying noise source is located). The indication could be given by touching at desired direction on a user interface, where the user is positioned on the centre, and top means directly forward and bottom means directly backwards. In such embodiments when the user gives this indication, the system adds a new masking audio object to the corresponding direction such that it matches the noise emanating from that direction.

In some embodiments the apparatus can be configured to render a marker tone from a single direction to the user, and the user is able to move the direction of the marker tone until it matches the direction of the sound to be masked. Moving the direction of the marker tone can be performed in any suitable manner, for example, by using the device joystick or dragging an icon depicting the marker tone location on the user interface.

In some embodiments the user interface can provide a user indication on whether the current masking sound is working well. This can for example be implemented by a thumbs up or thumbs down icon which can be clicked on the device user interface while listening to music which is used as a masking sound. The indication the user provides can then be associated with the parameters with the current live audio objects and the masking audio objects. Where the indication was positive, the next time the system encounters similar live audio objects, it favours a similar masking audio object to be used, or in general, favours the masking audio object so that the object is used more often. Where the indication was negative, next time the system encounters a similar situation (similar live audio objects), an alternative masking audio objects or track is found.

It shall be appreciated that the term user equipment is intended to cover any suitable type of wireless user equipment, such as mobile telephones, portable data processing devices or portable web browsers.

Furthermore elements of a public land mobile network (PLMN) may also comprise apparatus as described above.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising at least one processor and at least one memory including computer code for one or more programs, the at least one memory and the computer code configured to with the at least one processor cause the apparatus to:

determine metadata comprising one or more parameters describing a first sound source associated with a first audio signal;

in an instance when at least one value of the one or more parameters is greater than a determined threshold value, generate, by the apparatus, a second audio signal, wherein the second audio signal comprises at least in part a same characteristic as at least one of the one or more parameters;

mix the first audio signal and the second audio signal such that the second audio signal is associated with the first audio signal in such a way that the characteristic of the second audio signal is matched in time with at least one of the one or more parameters of the first audio signal so that the first audio signal and the second audio signal are aligned for playback; and cause to output the mixed first audio signal and the second audio signal together with the first audio signal.

2. The apparatus as claimed in claim 1, wherein the apparatus is further caused to position a second audio source associated with the second audio signal at a virtual location matching a virtual location of the first sound source associated with the first audio signal.

3. The apparatus as claimed in claim 2, wherein the apparatus is further caused to process the second audio source to match at least one of an audio source spectra and a time instance of the first sound source.

4. The apparatus as claimed in claim 1, wherein the one or more parameters comprise at least one of: a direction; a distance; and a loudness of the first sound source associated with the first audio signal.

5. The apparatus as claimed in claim 1, wherein the first audio signal is encoded in accordance with a surround sound codec comprising Moving Picture Experts Group (MPEG) surround and parametric object based MPEG spatial audio object coding (SAOC).

6. The apparatus as claimed in claim 1, wherein the first audio signal is at least a received audio signal via a receiver.

7. The apparatus as claimed in claim 1, wherein the first audio signal is at least a retrieved audio signal via a memory.

8. A method comprising:

determining metadata comprising one or more parameters describing a first sound source associated with a first audio signal;

in an instance when at least one value of the one or more parameters is greater than a determined threshold value, generating a second audio signal, wherein the second audio signal comprises at least in part a same characteristic as at least one of the one or more parameters;

mixing the first audio signal and the second audio signal such that the second audio signal is associated with the first audio signal in such a way that the characteristic of the second audio signal is matched in time with at least one of the one or more parameters of the first audio signal so that the first audio signal and the second audio signal are aligned for playback; and causing to output the mixed first audio signal and the second audio signal together with the first audio signal.

9. The method as claimed in claim 8, wherein the method further comprises:

causing to position a second audio source associated with the second audio signal at a virtual location matching a virtual location of the first sound source associated with the first audio signal.

10. The method as claimed in claim 9, wherein the method further comprises:

causing to process the second audio source to match at least one of an audio source spectra and a source time instance of the first sound source.

11. The method as claimed in claim 8, wherein the one or more parameters comprise at least one: of a direction; a distance; and a loudness of the first sound source associated with the first audio signal.

12. The method as claimed in claim 8, wherein the first audio signal is encoded in accordance with a surround sound codec comprising Moving Picture Experts Group (MPEG) surround and parametric object based MPEG spatial audio object coding (SAOC).

13. The method as claimed in claim 8, wherein the first audio signal is at least a received audio signal via a receiver.

14. The method as claimed in claim 8, wherein the first audio signal is at least a retrieved audio signal via a memory.

15. A computer program product comprising a non-transitory computer-readable storage medium having program code portions embodied therein, the program code portions being configured to, upon execution, cause an apparatus to at least:

determine metadata comprising one or more parameters describing a first sound source associated with a first audio signal;

in an instance when at least one value of the one or more parameters is greater than a determined threshold value, generate, by the apparatus, a second audio signal, wherein the second audio signal comprises at least in part a same characteristic as at least one of the one or more parameters;

mix the first audio signal and the second audio signal such that the second audio signal is associated with the first audio signal in such a way that the characteristic of the second audio signal is matched in time with at least one of the one or more parameters of the first audio signal so that the first audio signal and the second audio signal are aligned for playback; and cause to output the mixed first audio signal and the second audio signal together with the first audio signal.

16. The computer program product as claimed in claim 15, wherein the program code portions are further configured to, upon execution, cause the apparatus to:

position a second audio source associated with the second audio signal at a virtual location matching a virtual location of the first sound source associated with the first audio signal.

17. The computer program product as claimed in claim 16, wherein the program code portions are further configured to, upon execution, cause the apparatus to:

process the second audio source to match at least one of an audio source spectra and a time instance of the first sound source.

18. The computer program product as claimed in claim 15, wherein the one or more parameters comprise at least one: of a direction; a distance; and a loudness of the first sound source associated with the first audio signal.

19. The computer program product as claimed in claim 15, wherein the first audio signal is encoded in accordance with a surround sound codec comprising Moving Picture Experts Group (MPEG) surround and parametric object based MPEG spatial audio object coding (SAOC).

20. The computer program product as claimed in claim 15, wherein the first audio signal is at least a received audio signal via a receiver.

* * * * *